US007576036B2

(12) United States Patent
Nagasaki et al.

(10) Patent No.: US 7,576,036 B2
(45) **Date of Patent: *Aug. 18, 2009**

(54) HEAT-SENSITIVE RECORDING MATERIAL, HEAT-SENSITIVE RECORDING METHOD AND METHOD FOR MANUFACTURING HEAT-SENSITIVE RECORDING MATERIAL

(75) Inventors: Hideo Nagasaki, Shizuoka-ken (JP); Hisato Nagase, Shizuoka-ken (JP); Toshihide Aoshima, Shizuoka-ken (JP); Shiki Ueki, Shizuoka-ken (JP)

(73) Assignee: FUJIFILM Corporation, Tokyo (JP)

( * ) Notice: Subject to any disclaimer, the term of this patent is extended or adjusted under 35 U.S.C. 154(b) by 419 days.

This patent is subject to a terminal disclaimer.

(21) Appl. No.: 11/497,400

(22) Filed: Aug. 2, 2006

(65) Prior Publication Data

US 2007/0032381 A1 Feb. 8, 2007

(30) Foreign Application Priority Data

Aug. 2, 2005 (JP) ..... 2005-224731

(51) Int. Cl.
*B41M 5/42* (2006.01)

(52) U.S. Cl. ..... 503/226; 427/150; 503/200

(58) Field of Classification Search ..... None
See application file for complete search history.

(56) References Cited

U.S. PATENT DOCUMENTS 4,895,828 A 1/1990 Yaguchi et al.

(Continued)

FOREIGN PATENT DOCUMENTS

JP 4-39085 A 2/1992

(Continued)

*Primary Examiner*—Bruce H Hess
(74) *Attorney, Agent, or Firm*—Sughrue Mion, PLLC

(57) ABSTRACT

A heat-sensitive recording material including at least one heat-sensitive recording layer and a protective layer provided in this order on a support, wherein the protective layer contains a compound represented by the following Formula (1) and/or a compound represented by the following Formula (2), a method for manufacturing the heat-sensitive recording material, and a heat-sensitive recording method using the heat-sensitive recording material provided.

Formula (1)

Formula (2)

17 Claims, 3 Drawing Sheets

U.S. PATENT DOCUMENTS

| | | | |
|---|---|---|---|
| 5,023,227 | A | 6/1991 | Matoba et al. |
| 7,148,181 | B2 | 12/2006 | Tanaka et al. |

FOREIGN PATENT DOCUMENTS

| | | | |
|---|---|---|---|
| JP | 6-340179 | A | 12/1994 |
| JP | 8-90913 | A | 4/1996 |
| JP | 8-230323 | A | 9/1996 |
| JP | 2000-218943 | A | 8/2000 |
| JP | 2002-144735 | A | 5/2002 |
| JP | 2002-362029 | A | 12/2002 |
| JP | 2004-299354 | A | 10/2004 |
| JP | 2004-338360 | A | 12/2004 |

HEAT-SENSITIVE RECORDING MATERIAL, HEAT-SENSITIVE RECORDING METHOD AND METHOD FOR MANUFACTURING HEAT-SENSITIVE RECORDING MATERIAL

CROSS-REFERENCE TO RELATED APPLICATION

This application claims priority under 35 USC 119 from Japanese Patent Application No. 2005-224731, the disclosure of which is incorporated by reference herein.

BACKGROUND OF THE INVENTION

1. Field of the Invention

The invention relates to a heat-sensitive recording material, a heat-sensitive recording method and a method for manufacturing a heat-sensitive recording material. More specifically, the invention relates to heat-sensitive recording materials with little head staining and low torque transport that are suitable for medical heat-sensitive recording materials, multicolored heat-sensitive recording materials, and the like, a method for manufacturing such heat-sensitive recording materials, and a heat-sensitive recording method using the heat-sensitive recording materials.

2. Description of the Related Art

In recent years, the heat-sensitive recording method has been developing in various fields since the method has, for example, the following advantages: (1) no development is necessary, (2) if the support for a heat-sensitive recording material is paper, the material is similar to standard paper, (3) operation is easy, (4) color density of the resultant image is high, (5) a recording device is simple, highly reliable and inexpensive, (6) no noise occurs at the time of recording, and (7) no maintenance is needed. The use of the heat-sensitive recording method has been expanding over the field of facsimiles and printers, the field of labels such as POS, and other fields.

With this background, in recent years, transparent heat-sensitive recording materials that can be applied to multicoloring, or can project an image or the like by an overhead projector, and can directly record an image on a light table, and heat-sensitive recording materials that can perform multicolored recording, have been developed.

In such transparent heat-sensitive recording materials, an image is formed, generally, through press bonding a heat-sensitive recording material to a thermal head by the use of a platen roll and applying heat in a pulsing state with the thermal head while transporting the heat-sensitive recording material by the platen roll or a driving gear installed separately. At this time, if the friction coefficient between the thermal head and the recording material is large and the fluctuation range is large, the transfer speed becomes not uniform and a density difference is generated in the main scanning direction of the head. Although the density difference is rarely a problem in the binary recording for facsimiles and POS, the density difference may be noticeable in printer use in which a gradation image is output and may deteriorate the image quality. For that reason, decreasing the friction coefficient between the thermal head and a material has previously been proposed (for example, see Japanese Patent Application Laid-Open (JP-A) Nos. 2002-144735 and 2004-338360); however, because the friction coefficient between the thermal head and the material depends on printing energy, density difference may yet occur in a medical image in which a wider dynamic range is needed, and improvement of this aspect is desired.

Moreover, in a heat-sensitive recording material in which multicolor recording is needed, printing of each color has been carried out separately over a number of times. While the addition of various kinds of lubricants in the protective layer has been carried out for the purpose of improving the prevention of head staining and the like (for example, see JP-A Nos. 6-340179 and 2002-362029), an unresolved problem is that dislocation in the positions of the sheet between early printing and the later printing (so-called disagreement in registration) occurs when the fluctuation range of the friction coefficient between the thermal head and the recording material is large, and improvement of this problem is desired.

SUMMARY OF THE INVENTION

The present invention has been achieved in consideration of the above-mentioned situation, and provides a heat-sensitive recording material, a method for manufacturing the heat-sensitive recording material and a heat-sensitive recording method using that heat-sensitive recording material.

The present inventors focused their attention on the transport torque of the platen roll transporting the heat-sensitive recording material as the index of the friction coefficient between the thermal head and the heat-sensitive recording material, and conducted an investigation into reducing this transport torque in all the wide recording energy areas or controlling the fluctuation range of the transport torque. Further, the present inventors have found that head staining is suppressed by adding a specific compound, and that (A) the transportability is improved by reducing the maximum torque, and (B) the transport stability is improved by reducing the fluctuation range of the transport torque, resulting in the completion of the invention.

A first aspect of the invention provides a heat-sensitive recording material comprising a support, and at least one heat-sensitive recording layer and a protective layer provided on the support in this order, and the protective layer contains a compound represented by the following Formula (1) and/or a compound represented the following Formula (2).

Formula (1)

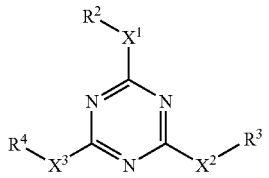

Formula (2)

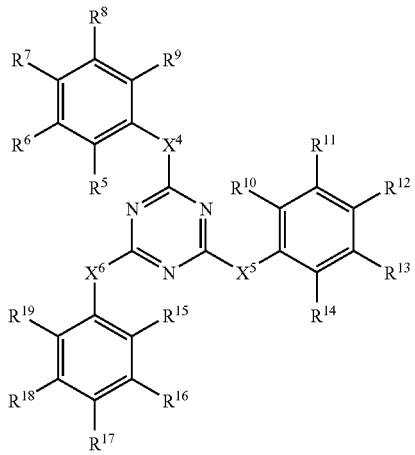

In Formulae (1) and (2), $X^1$ to $X^6$ each independently represent $NR^1$, S or O; $R^1$ represents a hydrogen atom, an alkyl group, an aryl group, an acyl group, an alkoxycarbonyl group, an aryloxycarbonyl group, or a carbamoyl group; $R^2$, $R^3$ and $R^4$ each independently represent a hydrogen atom, an alkyl group or a heterocyclic group; when at least two of $R^1$, $R^2$, $R^3$ and $R^4$ are other than a hydrogen atom, they may be bonded to each other to form a ring; $R^5$ to $R^{19}$ each independently represent a hydrogen atom, an alkyl group, an aryl group, an alkoxy group, an aryloxy group, an alkylthio group, an arylthio group, an acyloxy group, an acylamino group, an alkoxycarbonyl group, an aryloxycarbonyl group, a carbamoyl group, a sulfamoyl group, or a halogen atom; and when at least two of $R^5$ to $R^{19}$ are other than a hydrogen atom, they may be bonded to each other to form a ring.

A second aspect of the invention provides a heat-sensitive recording method comprising recording on the heat-sensitive recording material of the first aspect using a thermal head with a carbon ratio of 75% or more.

A third aspect of the invention provides the method for manufacturing a heat-sensitive recording material including dispersing a compound represented by the following Formula (1) and/or a compound represented by the following Formula (2) in an aqueous solution of a high-molecular weight compound through solid dispersion or emulsification, to form a dispersion liquid, and applying a coating liquid containing the dispersion liquid onto a support.

Formula (1)

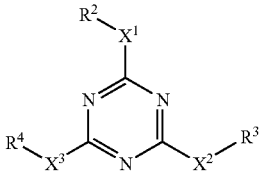

Formula (2)

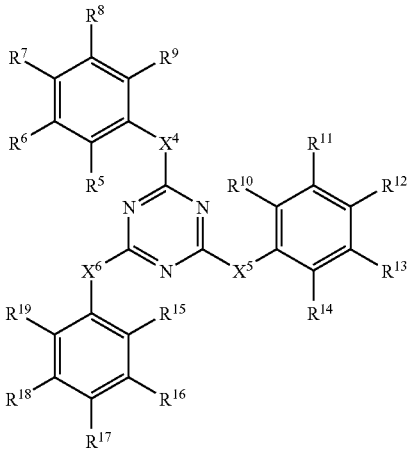

In Formulae (1) and (2), $X^1$ to $X^6$ each independently represent $NR^1$, S or O; $R^1$ represents a hydrogen atom, an alkyl group, an aryl group, an acyl group, an alkoxycarbonyl group, an aryloxycarbonyl group, or a carbamoyl group; $R^2$, $R^3$ and $R^4$ each independently represent a hydrogen atom, an alkyl group or a heterocyclic group; when at least two of $R^1$, $R^2$, $R^3$ and $R^4$ are other than a hydrogen atom, they may be bonded to each other to form a ring; $R^5$ to $R^{19}$ each independently represent a hydrogen atom, an alkyl group, an aryl group, an alkoxy group, an aryloxy group, an alkylthio group, an arylthio group, an acyloxy group, an acylamino group, an alkoxycarbonyl group, an aryloxycarbonyl group, a carbamoyl group, a sulfamoyl group, or a halogen atom; and when at least two of $R^5$ to $R^{19}$ are other than a hydrogen atom, they may be bonded to each other to form a ring.

DETAILED DESCRIPTION OF THE INVENTION

Figure 1:
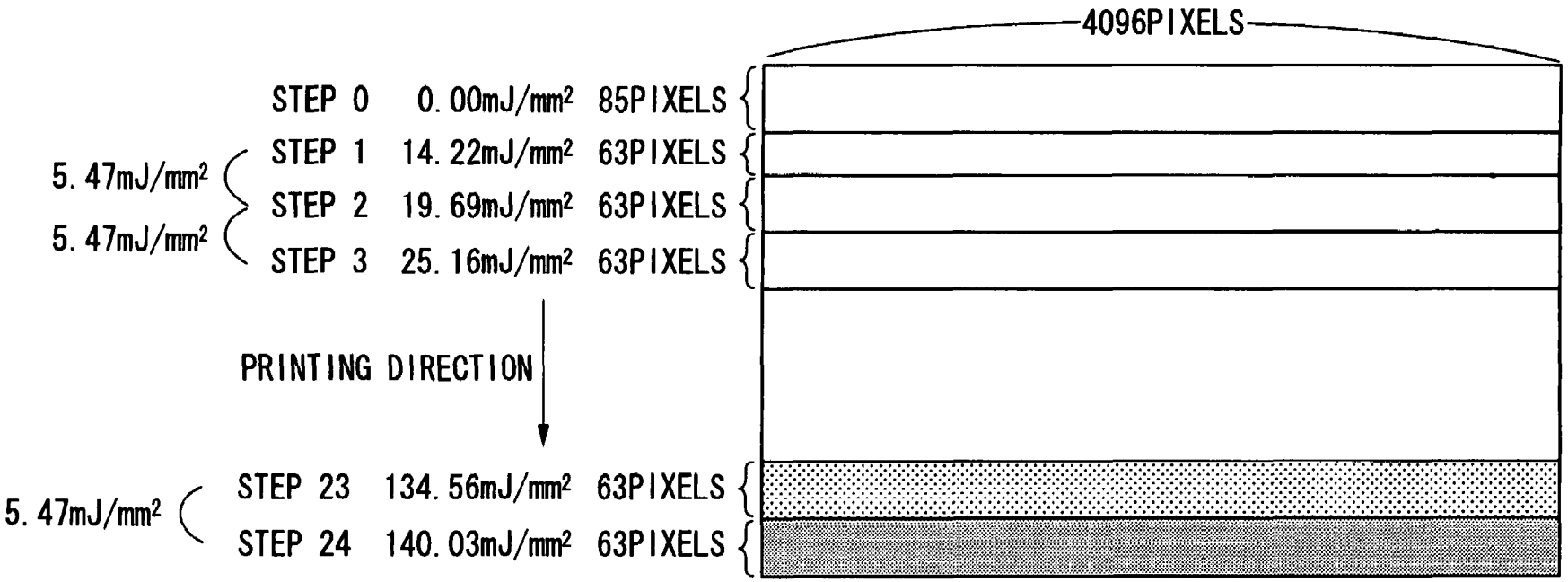
FIG. 1 illustrates the printing pattern of the transport torque evaluation in the Examples and Comparative Examples.

The heat-sensitive recording material of the invention includes at least one heat-sensitive recording layer and a protective layer on a support, and may further include a back layer, an intermediate layer, and other layers as occasion demands. Further, the heat-sensitive recording material of the invention contains a compound represented by the following Formula (1) and/or a compound represented by the following Formula (2) in the protective layer.

Hereinafter, the heat-sensitive recording material of the invention will be described in detail.

Formula (1)

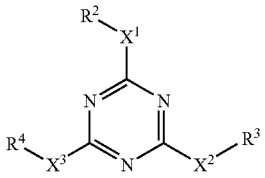

Formula (2)

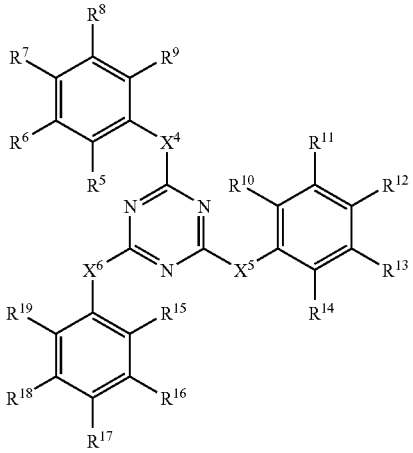

In Formulae (1) and (2), $X^1$ to $X^6$ each independently represent $NR^1$, S or O. $R^1$ represent a hydrogen atom, an alkyl group, an aryl group, an acyl group, an alkoxycarbonyl group, an aryloxycarbonyl group, or a carbamoyl group. $R^2$, $R^3$, and $R^4$ each independently represent a hydrogen atom, an alkyl group, or a heterocycle group. When at least two of $R^1$, $R^2$, $R^3$ and $R^4$ are other than a hydrogen atom, they may be bonded to each other to form a ring. $R^5$ to $R^{19}$ each independently represent a hydrogen atom, an alkyl group, an aryl group, an alkoxy group, an aryloxy group, an alkylthio group, an arylthio group, an acyloxy group, an acylamino group, an alkoxycarbonyl group, an aryloxycarbonyl group, a carbamoyl group, a sulfamoyl group, or a halogen atom. When at least two of $R^5$ to $R^{19}$ are other than a hydrogen atom, they may be bonded to each other to form a ring.

In Formulae (1) and (2), alkyl groups represented by $R^1$ to $R^{19}$ each may be a straight chain or cyclic alkyl group. The alkyl groups represented by $R^1$ to $R^{19}$ are each preferably an alkyl group having 1 to 30 carbon atoms, more preferably an alkyl group having 4 to 30 carbon atoms, and still more preferably an alkyl group having 8 to 30 carbon atoms. Preferable examples of the alkyl groups represented by $R^1$ to $R^{19}$ include a methyl group, an ethyl group, a normal propyl group, an isopropyl group, a normal butyl group, an isobutyl group, a tertiary butyl group, a normal hexyl group, a normal octyl group, a normal nonyl group, an isononyl group, a tertiary nonyl group, a cyclohexyl group, a decyl group, a dodecyl group, a tetradecyl group, a hexadecyl group, and an octadecyl group.

In Formulae (1) and (2), aryl groups represented by $R^1$, and $R^5$ to $R^{19}$ are each preferably an aryl group having 6 to 30 carbon atoms, more preferably an aryl group having 10 to 30 carbon atoms, and still more preferably an aryl group having 14 to 30 carbon atoms. Preferable examples of the aryl groups represented by $R^1$ and $R^5$ to $R^{19}$ include a phenyl group, a naphthyl group, an anthracenyl group, a phenathryl group, a pyrenyl group, and a perylenyl group.

In Formulae (1) and (2), an acyl group represented by $R^1$ is preferably an acyl group having 2 to 30 carbon atoms, more preferably an acyl group having 6 to 30 carbon atoms, and still more preferably an acyl group having 10 to 30 carbon atoms. Preferable examples of the acyl group represented by $R^1$ include an acetyl group, a propanoyl group, a hexanoyl group, an octanoyl group, a decanoyl group, a dodecanoyl group, a tetradecanoyl group, a hexadecanoyl group, an octadecanoyl group, and a benzoyl group.

In Formula (1), heterocyclic groups represented by $R^2$, $R^3$, and $R^4$ each may be either a saturated heterocycle or unsaturated heterocycle. The heterocyclic groups represented by $R^2$, $R^3$, and $R^4$ are each preferably a three-membered to ten-membered heterocycle, more preferably a four-membered to eight-membered heterocycle, and still more preferably a five-membered to seven-membered heterocycle. Preferable example of the heterocyclic groups represented by $R^2$, $R^3$, and $R^4$ include an oxazole ring, a thiazole ring, an imidazole ring, a pyrazole ring, a triazole ring, an isooxazole ring, an isothiazole ring, a furan ring, a thiophene ring, a pyrrole ring, a pyridine ring, a pyrimidine ring, and a triazine ring. However, in this case, the heterocyclic group does not need to be bonded to at the heteroatom part. The heterocyclic group may be a benzo-condensed ring. The heterocyclic group may have a substituent.

In Formula (2), alkoxy groups represented by $R^5$ to $R^{19}$ are each preferably an alkoxy group having 1 to 30 carbon atoms, more preferably an alkoxy group having 4 to 30 carbon atoms, and still more preferably alkoxy groups having 8 to 30 carbon atoms. Preferable examples of the alkoxy groups represented by $R^5$ to $R^{19}$ include a methoxy group, an ethoxy group, a normal propyloxy group, an isopropyloxy group, a normal butyloxy group, a tertiary butyloxy group, a normal hexyloxy group, a normal octyloxy group, a 2-ethylhexyloxy group, a 3,5,5-trimethylhexyloxy group, a normal decyloxy group, a normal dodecyloxy group, a normal tetradecyloxy group, a normal hexadecyloxy group, a normal octadecyloxy group, a cyclohexyloxy group, a benzyloxy group, an α-methylbenzyloxy group, a 4-vinylbenzyloxy group, a 3-vinylbenzyloxy group, an allyloxy group, a 2-methoxyethoxy group, and a 2-ethoxyethoxy group.

In Formula (2), aryloxy groups represented by $R^5$ to $R^{19}$ are each preferably an aryloxy group having 6 to 30 carbon atoms, more preferably an aryloxy group having 7 to 30 carbon atoms, and still more preferably an aryloxy group having 14 to 30 carbon atoms. Preferable examples aryloxy groups represented by $R^5$ to $R^{19}$ include a phenyloxy group, a naphthyloxy group, an anthracenyloxy group, a prenyloxy group, a 2-chlorophenyloxy group, a 4-methoxyphenyloxy group, a 4-phenoxyphenyloxy group, a 4-dodecylthiophenyloxy group, and a 4-cyanophenyloxy group.

In Formula (2), alkylthio groups represented by $R^5$ to $R^{19}$ may be a straight chain or cyclic alkylthio group. The alkylthio groups represented by $R^5$ to $R^{19}$ are each preferably an alkylthio group having 1 to 30 carbon atoms, more preferably an alkylthio group having 4 to 30 carbon atoms, and still more preferably an alkylthio group having 8 to 30 carbon atoms. Preferable examples of the alkylthio groups represented by $R^5$ to $R^{19}$ include a methylthio group, an ethylthio group, a normal propylthio group, an isopropylthio group, a normal butylthio group, an isobutylthio group, a tertiary butylthio group, a normal hexylthio group, a normal octylthio group, a normal nonylthio group, a normal decylthio group, a normal dodecylthio group, a normal tetradecylthio group, a normal hexadecylthio group, a normal octadecylthio group, an isononylthio group, a tertiary nonylthio group, a cyclohexylthio group, and allylthio group.

In Formula (2), arylthio groups represented by $R^5$ to $R^{19}$ are each preferably an arylthio group having 6 to 30 carbon atoms, more preferably an arylthio group having 10 to 30 carbon atoms, and still more preferably an arylthio group having 14 to 30 carbon atoms. Preferable examples of the arylthio groups represented by $R^5$ to $R^{19}$ include a phenylthio group, a naphthylthio group, an anthracenylthio group, a phenathrylthio group, a pyrenylthio group, a perylenylthio group, a 2-butoxyphenylthio group, a 2-benzoylaminophenylthio group, and a 3-octyloxyphenylthio group.

In Formula (2), acylamino groups represented by $R^5$ to $R^{19}$ each may be either an aliphatic acylamino group or an aromatic acylamino group. The acylamino groups represented by $R^5$ to $R^{19}$ are each preferably an acylamino group having 2 to 30 carbon atoms, more preferably an acylamino group having 4 to 30 carbon atoms, and still more preferably an acylamino group having 8 to 30 carbon atoms. Preferable examples of the acylamino groups represented by $R^5$ to $R^{19}$ include an acetylamino group, a propionylamino group, a normal octanoylamino group, a normal decanoylamino group, a normal dodecanoylamino group, a normal tetradecanoylamino group, a normal octadecanoylamino group, a benzoylamino group, a N-phenylacetylamino group, a N-methylacetylamino group.

In Formulae (1) and (2), carbamoyl groups represented by $R^1$ and $R^5$ to $R^{19}$ are each preferably a carbamoyl group having 2 to 30 carbon atoms, more preferably a carbamoyl group having 4 to 30 carbon atoms, and still more preferably a carbamoyl group having 8 to 30 carbon atoms. Preferable examples of the carbamoyl groups represented by $R^1$ and $R^5$ to $R^{19}$ include an ethylaminocarbonyl group, a butylaminocarbonyl group, a hexylaminocarbonyl group, an octylaminocarbonyl group, a dodecylaminocarbonyl group, an octadecylaminocarbonyl group, a diethylaminocarbonyl group, a dinormaloctylaminocarbonyl group, a dinormaldodecylaminocarbonyl group, a phenylaminocarbonyl group, a benzylaminocarbonyl group.

In Formula (2), acyloxy groups represented by $R^5$ to $R^{19}$ each may be either an aliphatic acyloxy group or an aromatic acyloxy group. The acyloxy groups represented by $R^5$ to $R^{19}$ are each preferably an acyloxy group having 2 to 30 carbon atoms, more preferably an acyloxy group having 4 to 30 carbon atoms, and still more preferably an acyloxy group having 8 to 30 carbon atoms. Preferable examples of the acyloxy groups represented by $R^5$ to $R^{19}$ include an acetyloxy group, a propionyloxy group, a n-octanoyloxy group, a n-decanoyloxy group, a benzoyloxy group, a N-phenylacetyloxy group, a N-methylacetyloxy group.

In Formulae (1) and (2), alkoxycarbonyl groups represented by $R^1$ and $R^5$ to $R^{19}$ are each preferably an alkoxycarbonyl group having 2 to 30 carbon atoms, more preferably an alkoxycarbonyl group having 4 to 30 carbon atoms, and still more preferably an alkoxycarbonyl group having 8 to 30 carbon atoms. P referable examples of the alkoxycarbonyl groups represented by $R^1$ and $R^5$ to $R^{19}$ include a methyloxycarbonyl group, an ethyloxycarbonyl group, a butyloxycarbonyl group, a 2-ethylhexyloxycarbonyl group, a decyloxycarbonyl group, a dodecyloxycarbonyl group, an octadecyloxycarbohyl group.

In Formula (1) and (2), aryloxycarbonyl groups represented by $R^1$ and $R^5$ to $R^{19}$ are each preferably a n aryloxycarbonyl group having 7 to 40 carbon atoms, more preferably an aryloxycarbonyl group having 10 to 40 carbon atoms, and still more preferably an aryloxycarbonyl group having 14 to 40 carbon atom. Preferable examples of the aryloxycarbonyl groups represented by $R^1$ and $R^5$ to $R^{19}$ include a phenyloxycarbonyl group, a naphthyloxycarbonyl group, an anthracenyloxycarbonyl group, and a pyrenyloxycarbonyl group.

In Formula (2), sulfamoyl groups represented by $R^5$ to $R^{19}$ are each preferably an sulfamoyl group having 0 to 30 carbon atoms, more preferably a sulfamoyl group having 6 to 30 carbon atoms, and still more preferably a sulfamoyl groups having 10 to 30 carbon atoms. Preferable examples the sulfamoyl groups represented by $R^5$ to $R^{19}$ include an unsubstituted sulfamoyl group, a N,N-dimethylsulfamoyl group, a N,N-diethylsulfamoyl group, a N,N-dibutylsulfamoyl group, a pyrrolidinosulfonyl group, a piperidinosulfonyl group, a morpholinesulfonyl group, a N'-sulfonylpiperazinosulfonyl group, and a hexamethyleneiminosulfonyl group.

In Formula (2), halogen atoms represented by $R^5$ to $R^{19}$ are each preferably a fluorine atom, a chlorine atom, a bromine atom, and an iodine atom, and more preferably a fluorine atom and a chlorine atom.

In Formulae (1) and (2), substituents represented by $R^1$ to $R^{19}$ each may have further a substituent. Preferable examples of the substituent which can be introduced to the substituents represented by $R^1$ to $R^{19}$ include an alkyl group, an aryl group, a halogen atom, an alkoxy group, an aryloxy group, an alkylthio group, an arylthio group, an alkoxycarbonyl group, an aryloxycarbonyl group, an alkoxycarbonylamino group, an aryloxycarbonylamino group, an acyloxy group, an acylamino group, a carbamoyl group, a carbamoylamino group, a sulfamoyl group, a sulfamoylamino group, a cyano group, a carboxylic acid group, a sulfonic acid group, a heterocyclic group.

In Formulae (1) and (2), at least one of $X^1$ to $X^6$ is preferably S, O, or NH. Moreover, $R^2$, $R^3$, and $R^4$ are each independently preferably an alkyl group having 8 or more carbon atoms, and more preferably an alkyl group having 8 to 22 carbon atoms. Further, $R^5$ to $R^{19}$ are each independently preferably a group having 4 or more carbon atoms, and more preferably a group having 6 to 22 carbon atoms.

In Formula (1), $X^1$—$R^2$, $X^2$—$R^3$, and $X^3$—$R^4$ are preferably the same from the viewpoint of the easiness of the synthesis, the environmental burden, and the cost.

Further, also in Formula (2), $X^4$-Ph-($R^5$)($R^6$)($R^7$)($R^8$)($R^9$), $X^5$-Ph-($R^{10}$)($R^{11}$)($R^{12}$) ($R^{13}$)($R^{14}$), and $X^6$-Ph-($R^{15}$)($R^{16}$)($R^{17}$)($R^{18}$)($R^{19}$) are preferably the same because of the same reasons. (Here, Ph represents a benzene ring.)

Synthesis of Compounds Represented by Formula (1) and Compounds Represented by Formula (2)

The general synthesis methods of 1,3,5-triazine compounds are described in "Methods of Organic Chemistry 4th edition volume E9C", Chapter 2.3 (667 to 796), (Written by E. SCHAUMANN, 1998, THIEME STUTTGART), which is incorporated by reference herein in its entirety, and the like. Moreover, JP-A No. 2004-331950, which is incorporated by reference herein in its entirety, also describes a synthesis method of 1,3,5-triazine compounds. Among them, the method of using a cyanuric chloride is relatively a simple method. The synthesis of the triazine compounds in the invention can be performed by the substitution reaction of cyanuric chloride with an amine, an aniline, a thiol, or an alcohol corresponding to a substituent of the final compound.

Formula (1)

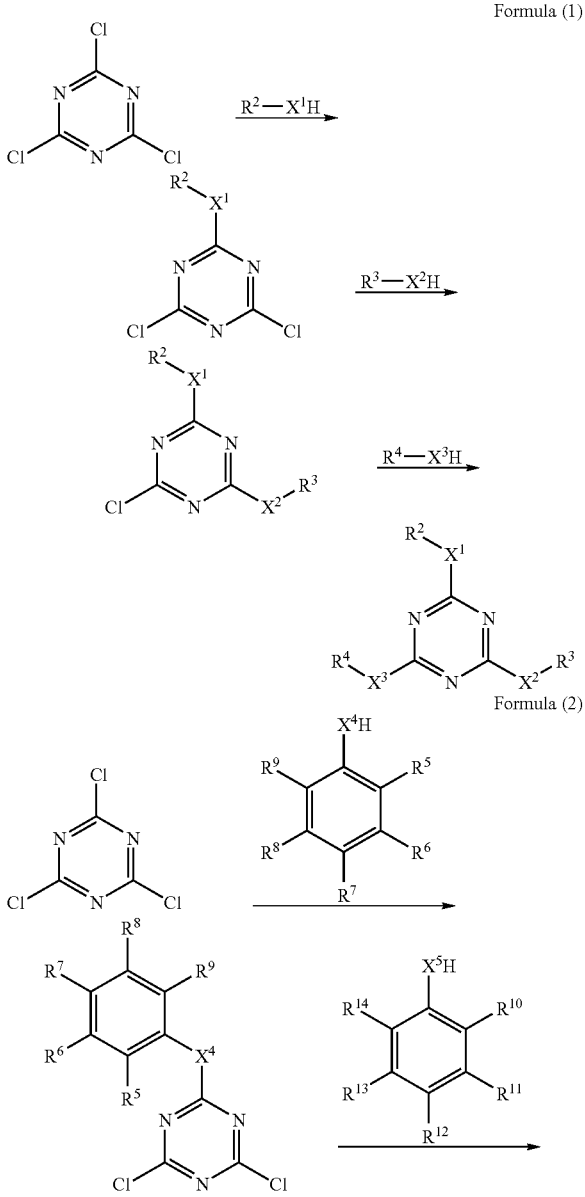

Formula (2)

-continued

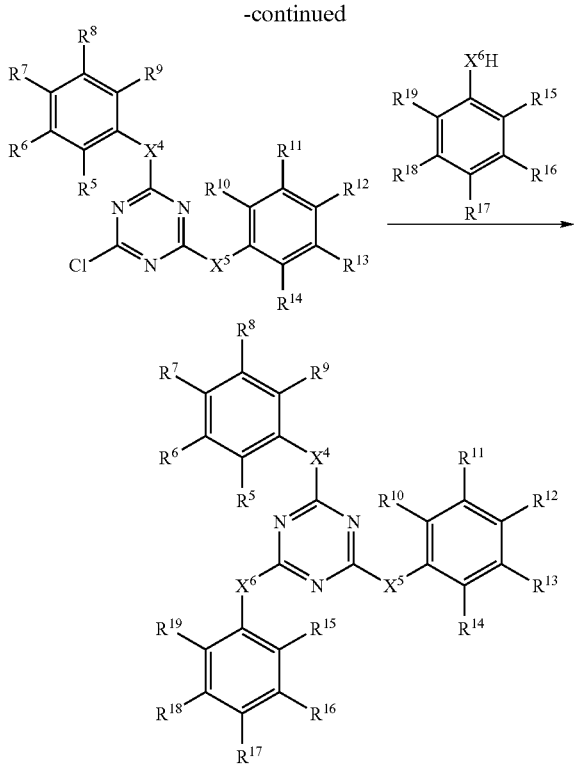

Formula (2)

In the method for synthesizing compounds represented by Formula (1) and compounds represented by Formula (2) in the invention, the following conditions can be used.

Examples of solvents to be used in the reaction include nitrile solvents such as acetonitrile and propionitrile; ester solvents such as ethyl acetate and butyl acetate; ketone solvents such as acetone and methyl ethyl ketone; ether solvents such as diethyl ether, tetrahydrofuran, methyl-t-butyl ether, and dioxane; amide solvents such as dimethylformamide and dimethylacetamide; halogenated hydrocarbon solvents such as chloroform, methylene chloride, dichloroethane and chlorobenzene; sulfolane, dimethyl sulfoxide, and water. The amount of the solvent used may be in the extent to which the raw material dissolves. When the concentration of the raw material is too high, the mixture may become highly viscous and its stirring efficiency may decrease, When the concentration of the raw material is too low, the volumetric efficiency may decrease. The reaction temperature may be be chosen within the range of −10° C. to 150° C.

As a deoxidizing agent, a basic compound may be used. In this case, either an inorganic basic compound or an organic basic compound may be used. Example thereof include sodium hydroxide, potassium hydroxide, sodium hydrogencarbonate, sodium carbonate, potassium carbonate, sodium acetate, potassium acetate, triethylamine, pyridine.

The methods for isolating the product after the completion of the reaction are not particularly limited, and the following methods may be used: such a method that water is added in the reaction system to crystallize the product, and the product is filtered and washed with water; and, such a method that water is added in the reaction system and the product is extracted with an organic solvent like ethyl acetate, toluene, diethyl ether, chloroform, methylene chloride, or the like, and the resultant is washed with water and then the solvent is removed by distillation. The methods for purifying the obtained product are not particularly limited, and usual purification methods such as recrystallization, column chromatography, and distillation can be used.

Hereinafter, specific examples (exemplary compounds: A-01 to A-57) of compounds represented by Formula (1) or compounds represented by Formula (2) will be shown, but the invention should not be limited to these compounds.

A-01

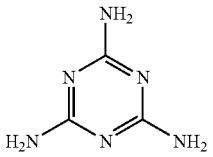

A-02

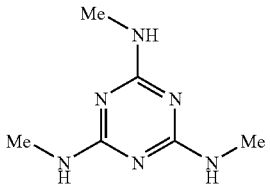

A-03

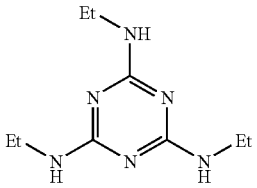

A-04

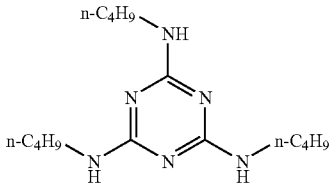

A-05

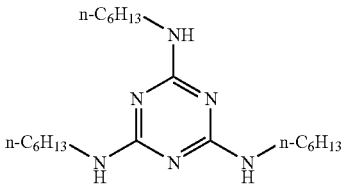

A-06

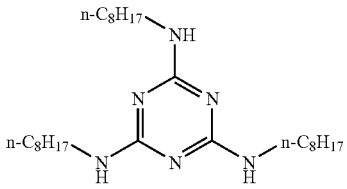

-continued
A-07
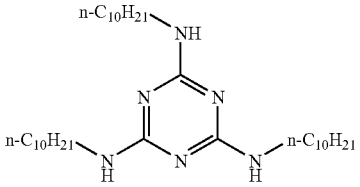
A-08
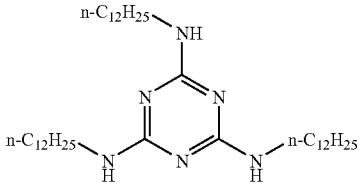
A-09
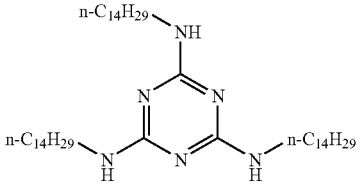
A-10
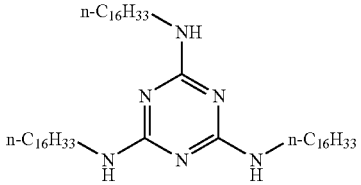
A-11
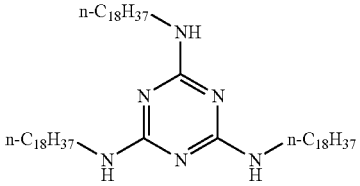
A-12
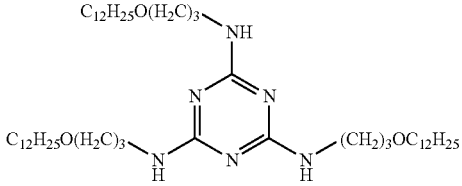
A-13
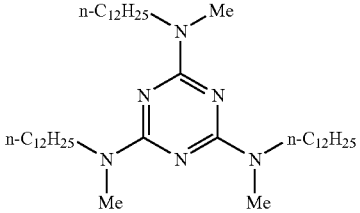
A-14
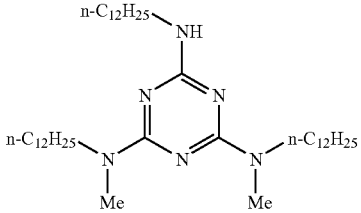
A-15
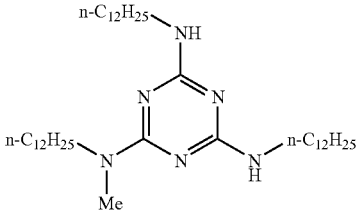
A-16
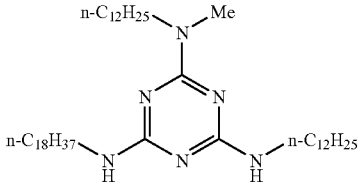
A-17
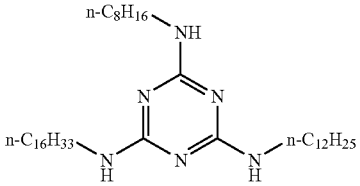
A-18
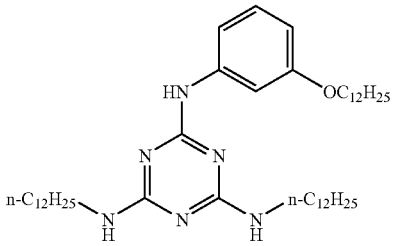
A-19
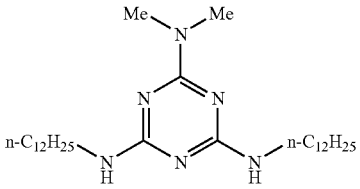
A-20
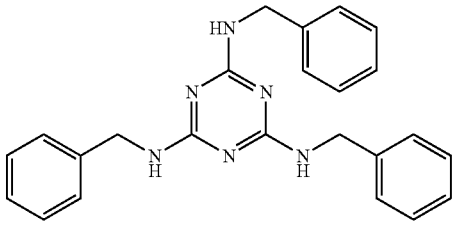

-continued
A-21
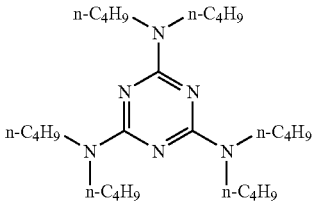
A-22
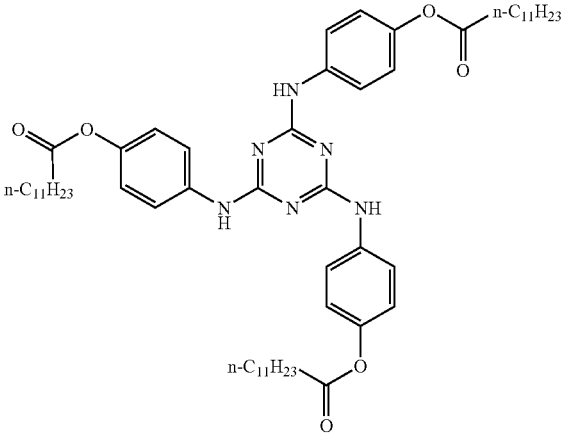
A-23
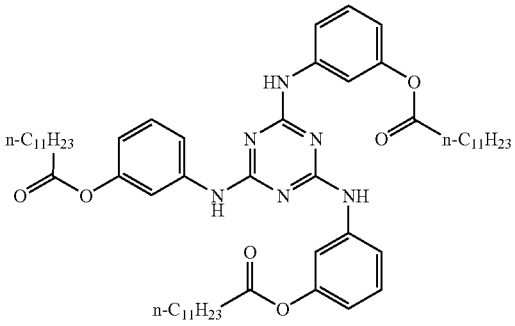
A-24
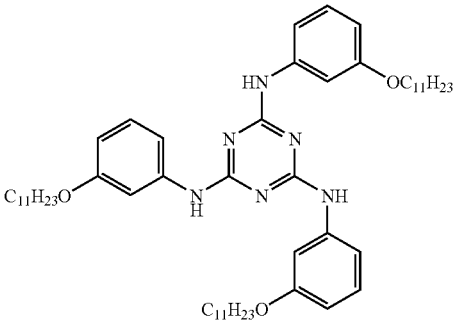
A-25
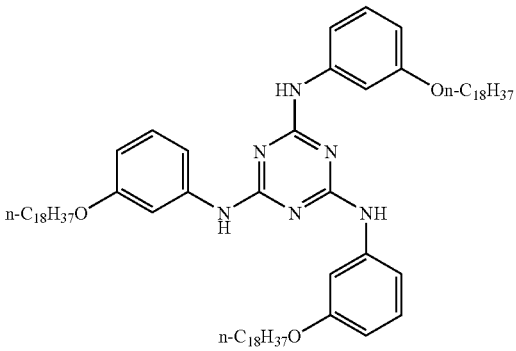
A-26
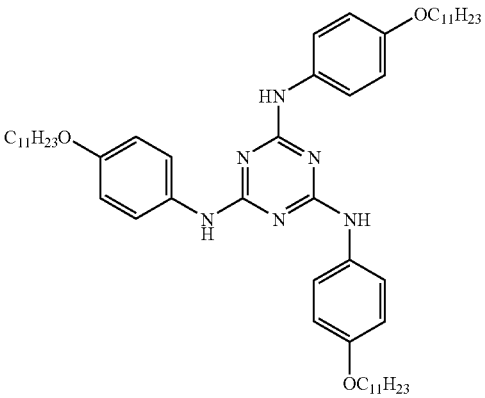

-continued
A-27
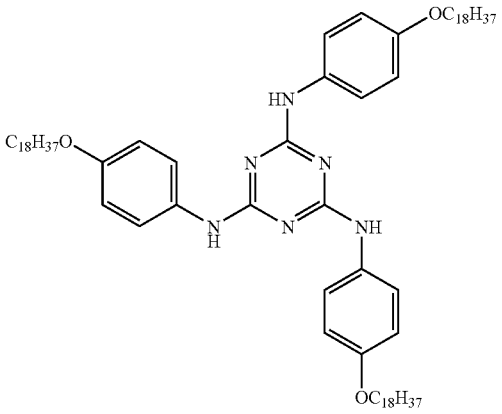
A-28
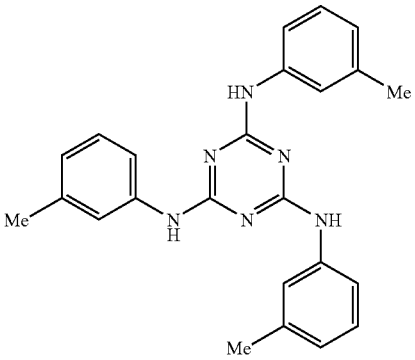
A-29
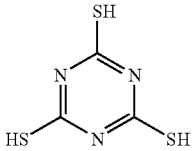
A-30
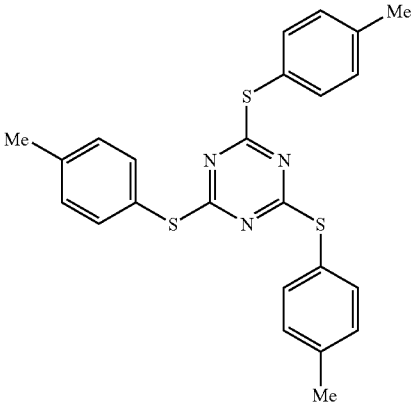
A-31
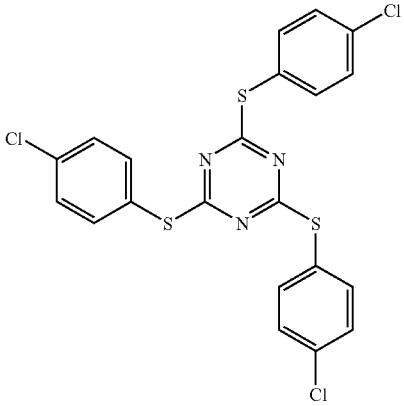
A-32
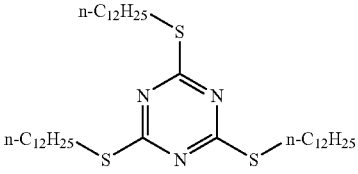

-continued
A-33
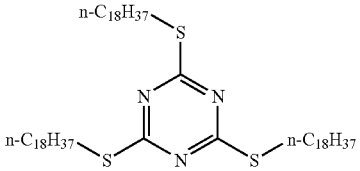
A-34
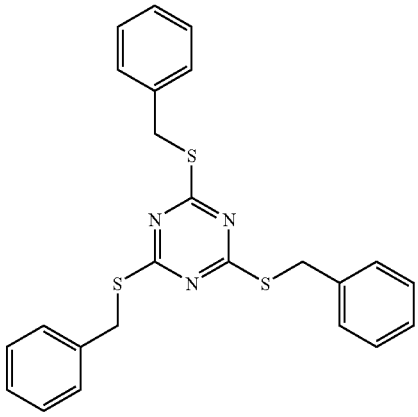
A-35
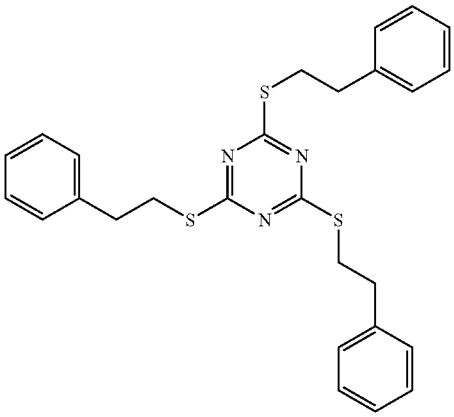
A-36
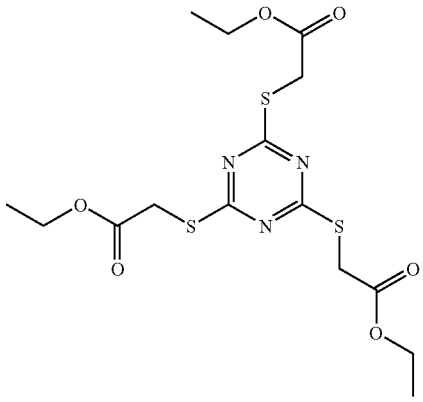
A-37
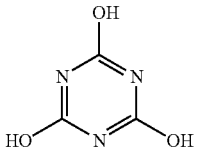
A-38
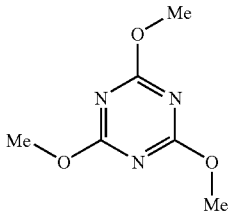
A-39
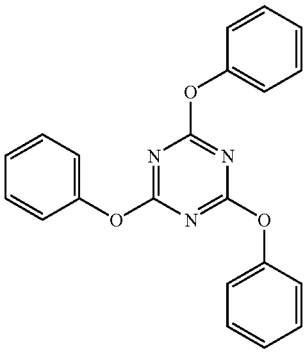
A-40
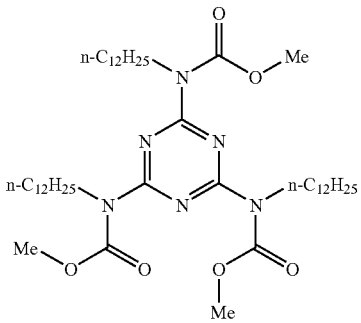

-continued
A-41
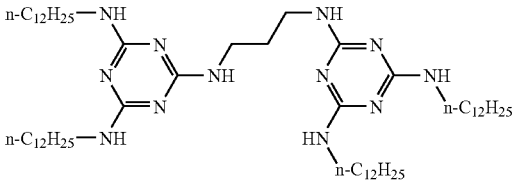
A-42
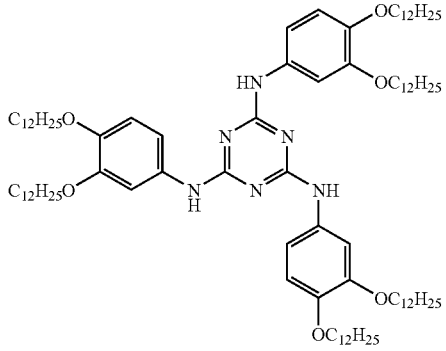
A-43
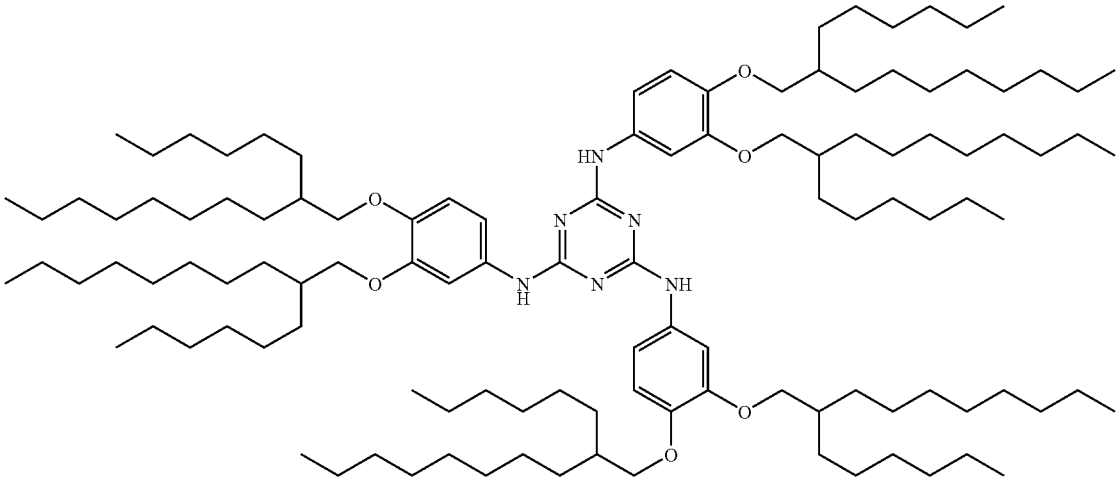
A-44
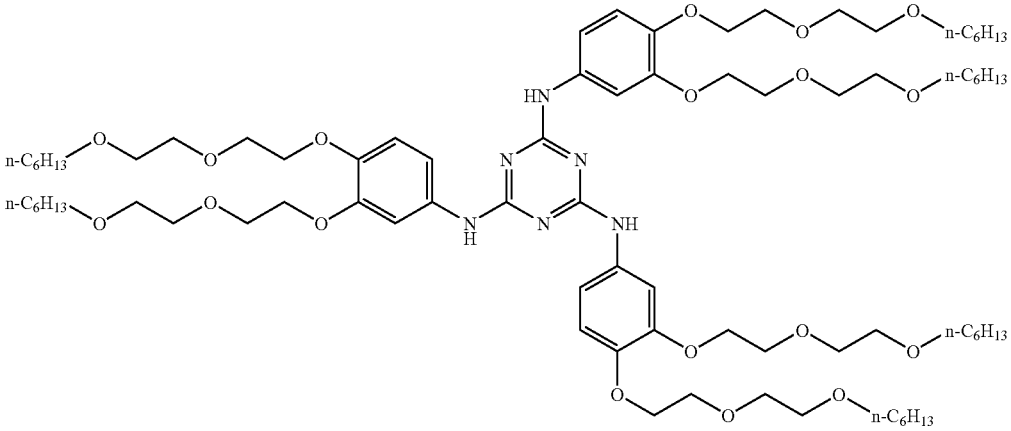

-continued
A-45
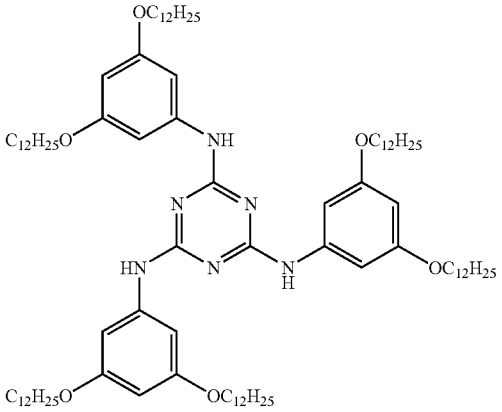
A-46
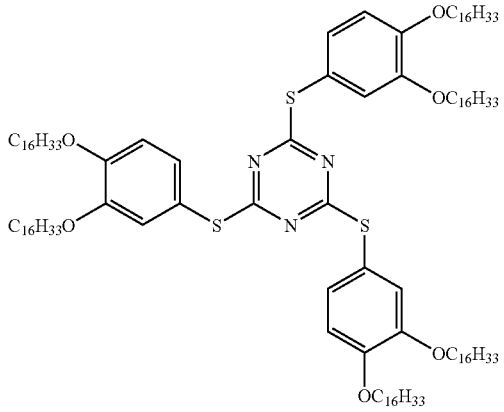
A-47
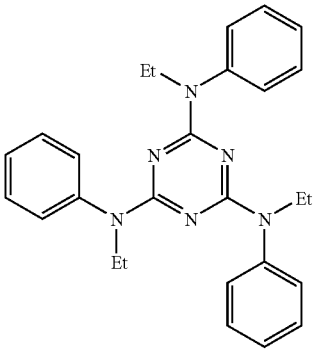
A-48
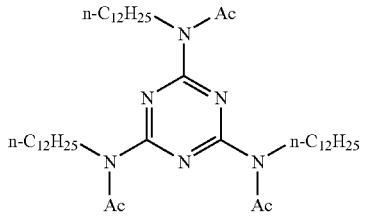
A-49
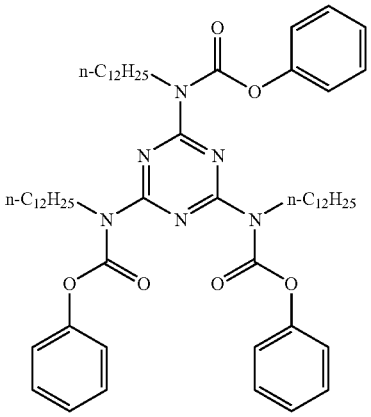
A-50
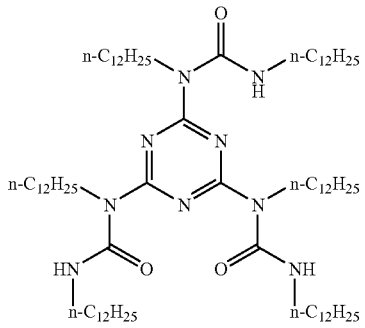
A-51
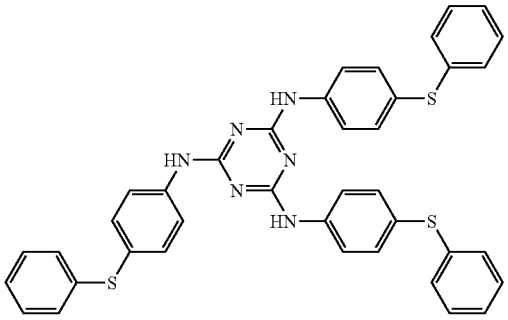
A-52
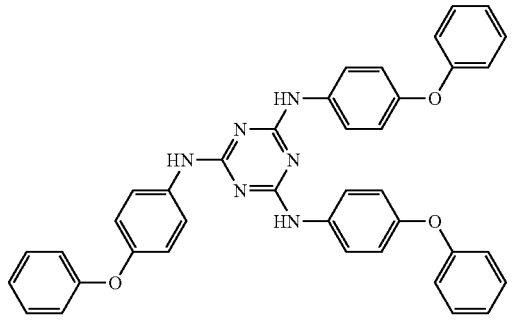

-continued

A-53

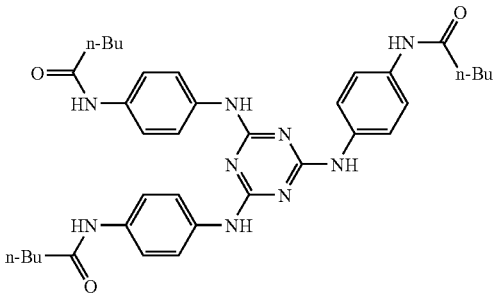

A-54

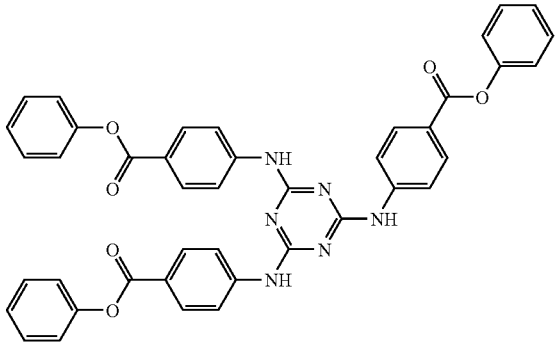

A-55

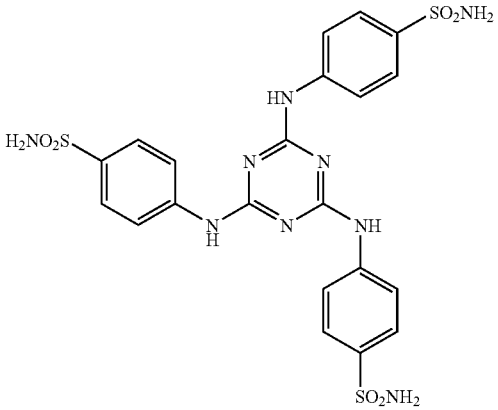

A-56

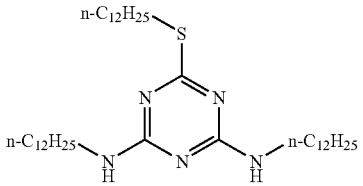

A-57

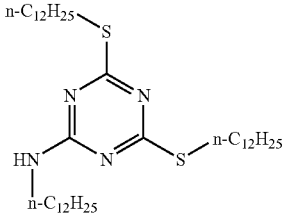

Method for Dispersing Compounds Represented by Formula (1) and Compounds Represented by Formula (2)

Compounds represented by Formula (1) and compounds represented by Formula (2) are, as described in the manufacturing method of the heat-sensitive recording material of the invention to be described later, preferably used (A) in the form of the solid dispersion obtained by dispersing the compound using a known disperser such as a homogenizer, a dissolver, or a sand mill in the presence of a dispersant such as a water-soluble polymer (eg. polyvinyl alcohol) or a surfactant or (B) in the form of the emulsion obtained by dissolving the compound in a solvent, and emulsifying the resultant in the aqueous solution of a dispersant such as a water-soluble polymer or a surfactant using a known emulsifier such as a homogenizer, a dissolver, or a colloid mill. The average particle size of the above-mentioned solid dispersion and emulsion is preferably 0.1 to 5.0 μm, and more preferably 0.1 to 2.0 μm. The average particle size here represents the 50% volume average particle size that is measured at the transmissivity of 71±1% by a laser diffraction particle-size distribution measuring device, LA910 (trade name) manufactured by Horiba, Ltd. Generally, dispersing the compound by the above-mentioned dispersion method (A) is preferable from the viewpoint of a light burden to the environment because of the use of no solvent. Moreover, the above-mentioned method (B) is preferable from the viewpoint of being possible to obtain the fine particle dispersion with the low energy consumption.

The total amount of compounds represented by Formula (1) and/or Formula (2) is preferably in the range of 0.05 to 50% by mass relative to the total dry application amount of the protective layer. More preferable range is 0.5 to 20% by mass, and still more preferable range is 1 to 10% by mass. In the protective layer of the heat-sensitive recording material in the invention, any of known pigments, binders, UV absorbents, surfactants, antifoaming agents, and known lubricants (paraffin wax, higher fatty acids, higher fatty acid salt, higher fatty acid amide, silicone compounds, fluorine-containing compounds, and the like) that have been conventionally used in the protective layer of a heat-sensitive recording material and/or thermally-meltable material may be used together.

Protective Layer

The protective layer means a layer provided on or above the heat-sensitive recording layer (the heat-sensitive recording layer is provided between the support and the protective layer), and is preferably the top surface layer. Hereinafter, the method for forming the protective layer in the invention will be described.

The pigments to be used in the protective layer in the invention are not particularly limited and any of known organic pigments and inorganic pigments can be used. Among them, inorganic pigments such as magnesium oxide, lead oxide, zirconium oxide, alumina, barium sulfate, potassium carbonate, titanium oxide, kaolin, aluminum hydroxide, amorphous silica, and zinc oxide, and organic pigments such as urea-formaldehyde resin and epoxy resin are preferable. Particularly, kaolin, aluminum hydroxide and amorphous silica are more preferable. These pigments may be used only in one kind, and two kinds or more of them may be used together. Moreover, in the above-mentioned pigments, a pigment on which surface is coated with at least one kind selected from the group consisting of higher fatty acids and metal salts of higher fatty acids, or of higher alcohols is preferably used. As the above-mentioned higher fatty acids, stearic acid, palmitic acid, myristic acid, lauric acid, and the like may be used.

These pigments are preferably used in being dispersed up to the above-mentioned preferable average particle size using a known disperser such as a dissolver, a sand mill, a ball mill, or the like in the presence of, for example, a dispersing auxiliary agent such as sodium hexametaphosphate, partially or completely saponified polyvinyl alcohol, polyacrylic acid copolymer, and a surfactant, preferably partially or completely saponified polyvinyl alcohol or an ammonium salt of polyacrylic acid copolymer. That is, a pigment is preferably used after being finely dispersed up to the range of 0.1 to 5.0 μm in 50% volume average particle size.

In the protective layer of the invention, a water-soluble resin is preferably used as a binder from -the viewpoint of making the protective layer good in transparency. Such water-soluble resins include polyvinyl alcohol (PVA) having a hydrophilic structural unit (a hydroxyl group and the like), carboxy-modified polyvinyl alcohol, silica-modified polyvinyl alcohol, acetoacetyl-modified polyvinyl alcohol, cation-modified polyvinyl alcohol, anion-modified polyvinyl alcohol, silanol-modified polyvinyl alcohol, polyvinyl acetal, gelatin, modified gelatin, starch, and modified starch.

Further, in the protective layer of the invention, it is preferable to use together and contain a crosslinking agent that can crosslink the above-mentioned water-soluble resin to raise the surface strength. As such a crosslinking agent, a boric acid compound is preferably used, and examples of the boric acid compounds include borax, boric acid, borate, diborate, metaborate, tetraborate, and pentaborate. Among them, borax, boric acid and borate are preferable because they can promptly cause the crosslinking reaction, and particularly boric acid is preferable.

Examples of crosslinking agents for water-soluble resins other than the above-mentioned ones include aldehyde compounds, ketone compounds, active halogenated compounds, active vinyl compounds, N-methylol compounds, melamine compounds, epoxy compounds, isocyanate compounds, aziridine compounds, carbodiimide compounds, ethylene-imino compounds, halogenated carboxyaldehyde compounds, dioxane compounds, metal-containing compounds, polyamine compounds, and hydrazide compounds. Among these, dialdehyde derivatives represented by the following structural formula [002], aldehyde compounds such as formaldehyde, glyoxal, succinaldehyde, gultaraldehyde, and dialdehyde starch; dialdehyde derivatives such as vegetable gum; and epoxy compounds such as ethylene glycol diglycidyl ether, propylene glycol diglycidyl ether, polyethylene glycol diglycidyl ether, diglycerin polyglycidyl ether, spiro glycol diglycidyl ether, and polyglycidyl ether such as phenol resin are preferable.

[002]

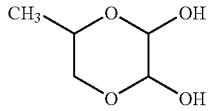

The above-mentioned crosslinking agents may be used only in one kind, and two or more kinds the crosslinking agents may be used in combinations. The amount of the above-mentioned crosslinking agent used in the protective layer is preferably 1 to 50% by mass, and more preferably 2 to 40% by mass, relative to the water-soluble resin.

In the invention, in order to form uniformly the protective layer on the heat-sensitive recording layer or on the intermediate layer, it is preferable to add a surfactant in the coating liquid for forming the protective layer. Preferable examples of the surfactant include alkali metal sulfosuccinate, and fluorine-containing surfactants. Specific examples thereof include sodium salt, potassium salt, or ammonium salt of di-(2-ethylhexyl) sulfosuccinic acid, di-(n-hexyl) sulfosuccinic acid, and the like, acetylene glycol derivatives, sodium perfluoroalkylsulfate, potassium perfluoroalkylsulfate, ammonium perfluoroalkylsulfonate, and perfluoroalkyl betaine compounds.

Further, in the above-mentioned protective layer, the fine particles of a metal oxide, an inorganic electrolyte, a polyelectrolyte, or the like may be added for the purpose of preventing the electrification of the heat-sensitive recording material. The above-mentioned protective layer may be of a single layer structure, or laminated structure of two or more layers. The protective layer is preferably the top surface layer from the viewpoint of enhancing the effect of the invention. The dry application amount of the above-mentioned protective layer is preferably 0.2 to 7 g/m$^2$, and more preferably 1 to 4 g/m$^2$.

<Heat-Sensitive Recording Layer>

The heat-sensitive recording layer of the invention includes at least a color forming component, and as necessary, may further contain other components.

As for the color forming component in the heat-sensitive recording layer, the component of any composition can be used as long as it has such property as is light-colored, colorless, or transparent when being untreated and is colored by application of heat.

Example of the heat-sensitive recording layer containing such color forming component include what is called two component type heat-sensitive recording layer, which contain a color forming component of substantially colorless (A) and a color forming component of substantially colorless (B) that form a color by reacting with that color forming component (A). Example of the combinations of two components for the two component type heat-sensitive recording layer include the following (a) to (m).

(a) a combination of an electron-donating dye precursor and an electron-accepting compound;

(b) a combination of a photolytic diazo compound and a coupler;

(c) a combination of a metal salt of an organic acid such as silver behenate or silver stearate and a reducing agent such as protocathechinic acid, spiroindane or hydroquinone;

(d) a combination of a salt of a long-chain fatty acid such as a ferric salt of stearic acid or a ferric salt of myristic acid and a phenol such as gallic acid or ammonium salicylate;

(e) a combination of a heavy metal salt of an organic acid such as a nickel, cobalt, lead, copper, iron, mercury or silver salt of acetic acid, stearic acid or palmitic acid and an alkali earth metal sulfide such as calcium sulfide, strontium sulfide or potassium sulfide, or a combination of such a heavy metal salt of organic acid and an organic chelate agent such as s-diphenylcarbazide or diphenylcarbazone;

(f) a combination of a (heavy) metal sulfide such as silver sulfide, lead sulfide, mercury sulfide or sodium sulfide and a sulfur compound such as Na-tetrathionate, sodium thiosulfate, or thiourea;

(g) a combination of a ferric salt of a fatty acid such as a ferric salt of stearic acid and an aromatic polyhydroxy compound such as 3,4-dihydroxytetraphenylmethane;

(h) a combination of a noble metal salt of an organic acid such as silver oxalate or mercury oxalate and an organic polyhydroxy compound such as polyhydroxyalcohol, glycerin or glycol;

(i) a combination of a ferric salt of a fatty acid such as a ferric salt of pelargonic acid or a ferric salt of lauric acid and a thiocetylcarbamide or isothiocetylcarbamide derivative;

(j) a combination of a lead salt an organic acid such as lead caprate, lead pelargonate, or lead behenate and a thiourea derivative such as ethylenethiourea or N-dodecylthiourea;

(k) a combination of a heavy metal salt of a higher fatty acid such as a ferric salt of stearic acid or copper stearate and zinc dialkyldithiocarbamate;

(l) a combination forming an oxazine dye, such as a combination of resorcin and a nitroso compound; and (m) a combination of a formazan compound and (a reducing agent and/or a metal salt).

Among these, in the heat-sensitive recording materials of the invention, it is preferable to use (a) a combination of an electron-donating dye precursor and an electron-accepting compound, (b) a combination of a photolytic diazo compound and a coupler, or (c) a combination of a metal salt of an organic acid and a reducing agent, and particularly the above-mentioned (a) or (b) is more preferable. Particularly, in case of making the multicolored heat-sensitive recording material, the above-mentioned (b) is preferable, and it is more preferable to laminate the heat-sensitive recording layer including the above-mentioned (a), or to laminate the heat-sensitive recording layer including (a) and the heat-sensitive recording layer including (b).

Further, the above-mentioned color forming component (A) or (B) is preferably contained in microcapsules (microencapsulated) or contained in composite fine particles. Particularly, when being microencapsulated, it is more preferable that the electron-donating dye precursor in case of the combination (a) and the photolytic diazo compound in case of the combination (b) are each microencapsulated.

Moreover, by using the heat-sensitive recording materials of the invention, an image excellent in transparency or in gloss can be obtained by constituting the heat-sensitive recording layer so that the haze value calculated from (diffuse transmittance/all-light transmittance)×100 (%) will be lowered. This haze value is generally calculated from the all-light transmission light amount, the diffuse transmission light amount and the parallel transmission light amount using a haze meter.

In the invention, the methods for lowering the above-mentioned haze value include, for example, (1) such a method that the 50% volume average particle sizes of both components of the above-mentioned color forming components (A and B) are made to be 1.0 μm or less and preferably 0.6 μm or less, and a binder is contained in the range of 30 to 60% by mass in the total solid content of the heat-sensitive recording layer, or (2) such a method that either one of the above-mentioned color forming components (A and B) is microencapsulated, and the other is used as one, for example, like emulsion that constitutes substantially a continuous layer after applying and drying. Further, (3) such a method is also effective that the refractive indexes of components to be used in the heat-sensitive recording layer are made as near as possible to a constant value.

The following will describe the above-mentioned combination (a), (b) and (c), which are preferably used in the heat-sensitive recording layer, in detail hereinafter.

Combination (a) of an Electron-Donating Dye Precursor and an Electron-Accepting Compound The electron-donating dye precursor which is preferably used in the invention is any electron-donating dye precursor that is substantially colorless. The precursor has a nature of donating an electron to form a color or accepting a proton from an acid to form a color, and is preferably a colorless compound having a partial skeleton of lactone, lactam, sultone, spiropyran, ester, amide or the like, the skeleton being opened or cleaved when the compound contacts with an electron-accepting compound.

Examples of the electron-donating dye precursor include triphenylmethanephthalide compounds, fluorane compounds, phenothiazine compounds, indolylphthalide compounds, leuco auramine compounds, rohdamine lactam compounds, triphenylmethane compounds, triazene compounds, spiropyran compounds, fluorene compounds, pyridine compounds and pyrazine compounds.

Specific examples of the phthalide compounds include compounds described in U.S. Reissued Pat. No. 23,024, and U.S. Pat. Nos. 3,491,111, 3,491,112, 3,491,116, and 3,509,174, the disclosures of which are incorporated by reference herein.

Specific examples of the fluorane compounds include compounds described in U.S. Pat. Nos. 3,624,107, 3,627,787, 3,641,011, 3,462,828, 3,681,390, 3,920,510, and 3,959,571, the disclosures of which are incorporated by reference herein.

Specific examples of the spiropyran compounds include compounds described in U.S. Pat. No. 3,971,808, the disclosure of which is incorporated by reference herein.

Specific examples of the pyridine compounds and the pyrazine compounds include compounds described in U.S. Pat. Nos. 3,775,424, 3,853,869 and 4,246,318, the disclosures of which are incorporated by reference herein.

Specific examples of the fluorene compounds include compounds described in JP-A No 63-094878, the disclosure of which is incorporated by reference herein.

Among these compounds, a particularly preferable example is 2-arylamino-3-[H, halogen, alkyl or alkoxy-6-substituted aminofluorane], which forms black color.

Specific examples thereof include 2-anilino-3-methyl-6-diethylaminofluorane, 2-anilino-3-methyl-6-N-cyclohexyl-N-methylaminofluorane, 2-p-chloroanilino-3-methyl-6-dibutylaminofluorane, 2-anilino-3-methyl-6-dioctylaminofluorane, 2-anilino-3-chloro-6-diethylaminofluorane, 2-anilino-3-methyl-6-N-ethyl-N-isoamylaminofluorane, 2-anilino-3-methyl-6-N-ethyl-N-dodecylaminofluorane, 2-anilino-3-methoxy-6-dibutylaminofluorane, 2-o-chloroanilino-6-dibutylaminofluorane, 2-p-chloroanilino-3-ethyl-6-N-ethyl-N-isoamylaminofluorane, 2-o-chloroanilino-6-p-butylanilinofluorane, 2-anilino-3-pentadecyl-6-diethylaminofluorane, 2-anilino-3-ethyl-6-dibutylaminofluorane, 2-o-toluidino-3-methyl-6-diisopropylaminofluorane, 2-anilino-3-methyl-6-N-isobutyl-N-ethylaminofluorane, 2-anilino-3-methyl-6-N-ethyl-N-tetrahydrofurfurylaminofluorane, 2-anilino-3-chloro-6-N-ethyl-N-isoamylaminofluorane, 2-anilino-3-methyl-6-N-methyl-N-γ-ethoxypropylaminofluorane, 2-anilino-3-methyl-6-N-ethyl-N-γ-ethoxypropylaminofluorane, 2-anilino-3-methyl-6-N-ethyl-N-γ-propoxypropylarninofluorane, 3',6'-bis(hexyloxy)-2-(2-thienyl)-spiro[4H-3,1-bezoxadine-4,9'-[9H]xanthrene], and 3',6'-bis(hexyloxy)-2-(2-phenyl)-spiro [4H-3,1-benzoxadine-4,9'-[9H]xanthrene].

Examples of the electron-accepting compound which reacts with the electron-donating dye precursor include acidic compounds such as phenol compounds, organic acids or metal salts thereof, and oxybenzoic esters. Compounds described in JP-A No. 61-291183, the disclosure of which is incorporated by reference herein, are specific examples thereof.

More specific examples thereof include bisphenol compounds such as 2,2-bis(4'-hydroxyphenyl)propane [common name: bisphenol A], 2,2-bis(4'-hydroxyphenyl)pentane, 2,2-bis(4'-hydroxy-3',5'-dichlorophenyl)propane, 1,1-bis(4'-hydroxyphenyl)cyclohexane, 2,2-bis(4'-hydroxyphenyl)hexane, 1,1-bis(4'-hydroxyphenyl)propane, 1,1-bis(4'-hydroxyphenyl)butane, 1,1-bis(4'-hydroxyphenyl)pentane, 1,1-bis(4'-hydroxyphenyl)hexane, 1,1-bis(4'-hydroxyphenyl)heptane, 1,1-bis(4'-hydroxyphenyl)octane, 1,1-bis(4'-hydroxyphenyl)-2-methyl-pentane, 1,1-bis(4'-hydroxyphenyl)-2-ethyl-hexane, 1,1-bis(4'-hydroxyphenyl)dodecane, 1,4-bis(p-hydroxyphenylcumyl)benzene, 1,3-bis(p-hydroxyphenylcumyl)benzene, bis(p-hydroxyphenyl)sulfone, bis(3-allyl-4-hydroxyphenyl)sulfone, and bis(p-hydroxyphenyl) benzyl acetate ester;

salicylic acid derivatives such as 3,5-di-α-methylbenzylsalicylic acid, 3,5-di-tert-butylsalicylic acid, 3-α-α-dimethylbenzylsalicylic acid, and 4-(β-p-methoxyphenoxyethoxy)salicylic acid;

polyvalent metal salts of the salicylic acid derivatives (preferably, zinc and aluminum salts of the salicylic acid derivatives);

oxybenzoic esters such as benzyl p-hydroxybenzoate, 2-ethylhexyl p-hydroxybenzoate, and β-resorcylic acid-(2-phenoxyethyl) ester; and phenols such as p-phenylphenol, 3,5-diphenylphenol, cumylphenol, 4-hydroxy-4'-isopropoxy-diphenylsulfone, and 4-hydroxy-4'-phenoxy-diphenylsulfone.

The bisphenol compounds are particularly preferable since they give a satisfactory color forming property.

A single kind of the electron-accepting compound may be used or a multiple kinds of the electron-accepting compounds may be simultaneously used.

Combination (b) of a Photolytic Diazo Compound and a Coupler

The photolytic diazo compound is a compound which couples with a coupler, which is a coupling component that will be detailed later, so as to form a desired color, and has a photolytic property so that the compound decomposes upon receiving light having a specific wavelength before the reaction whereby the compound loses color-forming ability any longer even in the presence of the coupling component.

The color hue by this color-forming system is determined by the diazo dye generated by the reaction between the photolytic diazo compound and the coupler. Accordingly, by changing the chemical structure of the diazo compound or the coupler, the color hue can be changed easily. Arbitrary color hue can be obtained by appropriate selection of the combination.

A photolytic diazo compound preferably used in the invention is an aromatic diazo compound, specific examples of which include aromatic diazonium salts, diazosulfonate compounds and diazoamino compounds.

Examples of the aromatic diazonium salts include the compounds represented by:

$$Ar—N_2^+.X^-$$

wherein Ar represents a substituted or unsubstituted aromatic hydrocarbon cyclic group, $N_2^+$ represents a diazonium group, and $X^-$ represents an acid anion. The aromatic diazonium salts are not limited to the examples. An aromatic diazonium salt that is used preferably has excellent photo-fixability, suppresses occurrence of colored stain after being fixed, and provides image whose colored portions are stable.

A number of diazosulfonate compounds have been known in recent years. The compounds are obtained by treating various diazonium salts with sulfite, and can be preferably used in the heat-sensitive recording materials of the invention.

The diazoamino compounds can be obtained by coupling a diazo group with dicyan diamide, sorcosine, methyltaurine, N-ethylanthranic acid-5-sulfonic acid, monoethanolamine, diethanolamine, guanidine, or the like, and can be preferably used in the heat-sensitive recording materials of the invention.

Details of these diazo compounds are described, for example, in JP-A No. 2-136286, the disclosure of which is incorporated by reference herein.

Examples of the coupler which couples with the above-mentioned diazo compound include 2-hydroxy-3-naphthoic acid anilide, resorcin, and the compounds described in JP-A No. 62-146678, the disclosure of which is incorporated by reference herein.

If the above-mentioned combination of a diazo compound and a coupler is used in the heat-sensitive recording layer, a basic substance as a sensitizer may be included in the heat-sensitive layer, since the coupling reaction between the diazo compound can be further promoted if the reaction is conducted in a basic environment.

Examples of the basic substance include water-insoluble or scarcely water-soluble basic materials and materials which generate alkali by heat. Examples thereof include nitrogen-containing compounds such as inorganic or organic ammonium salts, organic amines, amides, urea and thiourea or derivatives thereof, thiazoles, pyrroles, pyrimidines, pyperazines, guanidines, indoles, imidazoles, imidazolines, triazoles, morpholines, piperidines, amidines, formazines, and pyridines.

The basic substances described in JP-A No. 61-291183, the disclosure of which is incorporated by reference herein, can be cited as specific examples.

Combination (c) of an Organic Metal Salt and a Reducing Agent

Combination (c) of an organic metal salt and a reducing agent will be described.

Specific examples of the organic metal salt include silver salts of long-chain aliphatic carboxylic acids, such as silver laurate, silver myristate, silver palmitate, silver stearate, silver arachate, and silver behenate; silver salts of organic compounds each having an imino group, such as benzotriazole silver salts, benzimidazole silver salts, carbazole silver salts and phthalazinone silver salts; silver salts of sulfur-containing compounds, such as s-alkylthioglycolate; silver salts of aromatic carboxylic acids, such as silver benzoate and silver phthalate; silver salts of sulfonic acids, such as silver ethansulfonate; silver salts of sulfinic acids, such as silver o-toluenesulfinate; silver salts of phosphoric acid, such as silver phenylphosphate; silver baribiturate, silver saccharate, and silver salts of salicylasdoxime; and mixtures thereof.

Among these examples, silver salts of long-chain aliphatic carboxylic acids are preferable. In particular, silver behenate is more preferable. Behenic acid may be used together with silver behenate.

As the reducing agent, one or more selected from the compounds described in JP-A No. 53-1020, the disclosure of which is incorporated by reference herein, page 227, lower-left column, line 14 to page 229, upper-right column, line 11 can be appropriately used. In particular, the following can be preferably used: mono-, bis-, tris- or tetrakis-phenols, mono- or bis-naphthols, di- or poly-hydroxynaphthalenes, di- or poly-hydroxybenzenes, hydroxy monoethers, ascorbic acids, 3-pyrazolidones, pyrazolines, pyrazolones, reducing sugars, phenylenediamines, hydroxylamines, reductones, hydroxamines, hydrazides, amideoximes, and N-hydroxyureas.

Among these examples, aromatic organic reducing agents such as polyphenols, sulfonamidephenols, and naphthols are more preferable.

In order to ensure the sufficient transparency as the heat-sensitive recording material, it is preferable to use (a) a combination of an electron-donating dye precursor and an electron-accepting compound or (b) a combination of a photolytic diazo compound and a coupler in the above-mentioned heat-sensitive recording layer. Moreover, in the invention, either one of the above-mentioned color forming components (A) and (B) is preferably used in the microencapsulated state or as fine particles, and it is more preferable to use the above-mentioned electron-donating dye precursor or the photolytic diazo compound in the state of being microencapsulated or being made to be composite fine particles. Embodiment in which the above-mentioned electron-donating dye precursor or the photolytic diazo compound is microencapsulated is more preferable from the viewpoint of the storage stability of images, and the like.

Microcapsule

The process for producing the microcapsules will be described in detail hereinafter.

The interfacial polymerization method, the internal polymerization method, and the external polymerization method are known as methods for producing microcapsules. Any one thereof may be employed.

As described above, it is preferable in preparation of the heat-sensitive recording material of the invention to microencapsulate the electron-donating dye precursor or the photolytic diazo compound. It is particularly preferable to employ the interfacial polymerization method, which comprises the step of mixing an oil phase prepared by dissolving or dispersing the electron-donating dye precursor or the photolytic diazo compound, which will be cores of capsules, in a hydrophobic organic solvent with a water phase comprising a dissolved water-soluble polymerizable substance, the step of emulsifying the mixture by means of a homogenizer or the like, and the step of heating the emulsion to cause polymerization at the interface between the oil droplets and water, thereby forming microcapsule walls made of the resultant polymer.

The reactants for making the polymer material are added to the inside and/or the outside of the oil droplets. Specific examples of the polymer include polyurethane, polyurea, polyamide, polyester, polycarbonate, urea-formaldehyde resin, melamine resin, polystyrene, and styrene-methacrylate copolymer, styrene-acrylate copolymer. Among these polymers, polyurethane, polyurea, polyamide, polyester, and polycarbonate are preferable. Polyurethane and polyurea are more preferable.

For example, if polyurea is used for the material of the capsule walls, microcapsule walls can easily be formed by causing polyisocyanate such as diisocyanate, triisocyanate, tetraisocyanate or polyisocyanate prepolymer to react with a polyamine such as diamine, triamine or tetraamine, a prepolymer having 2 or more amino groups, piperazine or a derivative thereof, or a polyol in the above-mentioned water phase by the interfacial polymerization method.

For example, composite walls composed of polyurea and polyamide, or composite walls composed of polyurethane and polyamide can be prepared by incorporating polyisocyanate and a second material which reacts with the polyisocyanate to form capsule walls (for example, acid chloride, polyamine or polyol) into an aqueous solution (water phase) of a water-soluble polymerizable substance or an oil medium (oil phase) to be capsulated, emulsifying the mixture, and heating the resultant emulsion. Details of this method of producing the composite walls made of polyurea and polyamide are described in JP-A No. 58-66948.

The polyisocyanate compound is preferably a compound having three or more functional isocyanate groups. A bi-functional isocyanate compound may be used together.

Specific examples of the polyisocyanate compound include a diisocyanate (such as xylene diisocyanate or a hydrogenated product thereof, hexamethylene diisocyanate, tolylene diisocyanate or a hydrogenated product thereof, or isophorone diisocyanate) as a main raw material; dimers or trimers thereof (biurets or isocyanurates); polyfuctional adducts of polyols (such as trimethylolpropane) with bi-functional isocyanates (such as xylylene diisocyanate); compounds obtained by introducing high molecular-weight compound (for example, a polyether having active hydrogen atoms, such as polyethylene oxide) into adducts of polyols (such as trimethylolpropane) with bi-functional isocyanates (such as xylylene diisocyanate); and condensates of benzene isocyanate with formalin.

The compounds described in JP-ANos. 62-212190 and 4-26189, 5-317694 and 10-114153, the disclosures of which are incorporated by reference herein, are preferable.

The polyisocyanate is preferably added so that the average particle size of the microcapsules will be from 0.05 to 12 μm and the thickness of the capsule walls thereof will be from 5 to 300 nm. The size of the dispersed particle is generally from about 0.1 to 10 μm.

Specific examples of the polyol and/or the polyamine, which reacts with the polyisocyanate and is added as one of the components of the microcapsule wall to the water phase and/or the oil phase, include propylene glycol, glycerin, trimethylolpropane, triethanloamine, DETA, sorbitol, and hexamethylenediamine. When the polyol is added thereto, polyurethane walls are formed. In the above-mentioned reaction, it is preferable to keep the reaction temperature high or add an appropriate polymerization catalyst in order to increase the reaction velocity.

The polyisocyanate, the polyol, the reaction catalyst or the polyamide for forming a part of capsule walls, and the like are described in detail in published books (see, for example, *Polyurethane Handbook*, edited by Keiji Iwata and published in the Nikkan Kogyo Shimbun, Ltd. (1987), the disclosure of which is incorporated by reference herein).

If necessary, a charge adjusting agent such as a metal-containing dye or nigrosin, or any other additive may be added to the microcapsule walls. These additives can be added at the time of forming the walls, or at any other time, to be incorporated in the walls of the capsules. If necessary, a monomer such as a vinyl monomer may be graft-polymerized in order to adjust the charging property of the surfaces of the capsule walls.

In order to make the microcapsule walls having excellent substance-permeability and color-forming ability even at lower temperatures, it is preferable to use a plasticizer suitable for the polymer used as the wall material. The plasticizer has a melting point of preferably 50° C. or more, more preferably 120° C. or less. It is particularly preferable to select a plasticizer which has such a melting point and takes a solid form at ordinary temperature.

For example, when the wall material is polyurea or polyurethane, it is preferable to use a hydroxy compound, a carbamic ester compound, an aromatic alkoxy compound, an organic sulfonamide compound, an aliphatic amide compound, an arylamide compound or the like.

When the above-mentioned oil phase is adjusted, as an organic solvent that is used to dissolve the electron-donating dye precursor to form cores of microcapsules, such a solvent with a low boiling point of 50 to 150° C. is preferable that has high solubility and does not remain within the microcapsules after the microencapsulation reaction. Examples of such solvents include esters organic solvents such as ethyl acetate, isopropyl acetate, and butyl acetate, and methylene chloride. Ethyl acetate is more preferable.

When the electron-donating dye precursor as a solute is low in solubility, or when the electron-denoting dye precursor is high in polarity and cannot be preferably separated from microcapsule walls, a hydrophobic oil with a relatively high boiling point can be used together. Since hydrophobic oil remains within capsules after the encapsulation reaction, it might affect the storage stability of an image in some cases. However phosphates such as tricresyl phosphate, and borates such as tributyl borate can be preferably used, and particularly, tricresyl phosphate is relatively good in the emulsification stability and the storage stability of an image and is preferably used.

When the above-mentioned oil phase is prepared, it is preferable to use an organic solvent having a boiling point of 100 to 300° C. as a hydrophobic organic solvent in which the photolytic diazo compound dissolves before cores of microcapsules are formed.

Specific examples thereof include esters, dimethylnaphthalene, diethylnaphthalene, diisopropylnaphthalene, dimethylbiphenyl, diisopropylbiphenyl, diisobutylbiphenyl, 1-methyl-1-dimethylphenyl-2-phenylmethane, 1-ethyl-1-dimethylphenyl-1-phenylethane, 1-propyl-1-dimethylphenyl-1-phenylethane, triallylmethane (such as tritoluylmethane and toluyldiphenylmethane), terphenyl compounds (such as terphenyl), alkyl compounds, alkylated diphenyl ether compounds (such as propyldiphenyl ether), hydrogenated terphenyl compounds (such as hexahydroterphenyl), and diphenyl ether. Among these examples, esters are particularly preferable from the viewpoints of the emulsification stability of the emulsion.

Examples of the esters include phosphate esters such as triphenyl phosphate, tricresyl phosphate, butyl phosphate, octyl phosphate and cresylphenyl phosphate; phthalic esters such as dibutyl phthalate, 2-ethylhexyl phthalate, ethyl phthalate, octyl phthalate, and butylbenzyl phthalate; dioctyl tetrahydrophthalate; benzoic esters such as ethyl benzoate, propyl benzoate, butyl benzoate, isopentyl benzoate, and benzyl benzoate; abietic esters such as ethyl abietate, and benzyl abietate; dioctyl adipate; isodecyl succinate; diocyl azelate; oxalic esters such as dibutyl oxalate and dipentyl oxalate; diethyl malonate; maleic esters such as dimethyl maleate, diethyl maleate, and dibutyl maleate; tributyl citrate; sorbic esters such as methyl sorbate, ethyl sorbate and butyl sorbate; sebacic esters such as dibutyl sebacate, and dioctyl sebacate; ethylene glycol esters such as formic monoester and diester, butyric monoester and diester, lauric monoester and diester, palmitic monoester and diester, stearic monoester and diester, and oleic monoester and diester; triacetin; diethyl carbonate; diphenyl carbonate; ethylene carbonate; propylene carbonate; boric esters such as tributyl borate and tripentyl borate.

Among them, it is preferable to use, as the organic solvent, tricresyl phosphate alone or in combination with other solvent(s) since the stability of the emulsion becomes most satisfactory. The above-mentioned oils may be used in any combination thereof, or the ester oil(s) may be used together with an oil other than the above-mentioned oils.

If the solubility of the electron-donating dye precursor or the photolytic diazo compound, which is to be capsulated, in the hydrophobic organic solvent is low, a low boiling point solvent in which the electron-donating dye precursor or the photolytic diazo compound dissolves well may be used simultaneously as an auxiliary solvent. Preferable examples of the low boiling point solvent include ethyl acetate, isopropyl acetate, butyl acetate and methylene chloride.

The water phase may be an aqueous solution comprising a dissolved water-soluble polymer as a protective colloid. The above-mentioned oil phase is added to the water phase, and then the mixture is emulsified with a homogenizer or the like. The water-soluble polymer acts as a dispersing medium for achieving homogeneous dispersion easily and stabilizing the emulsified solution. A surfactant may be added to at least one of the oil phase and the water phase in order to achieve more homogenous and stable dispersion. As the surfactant, a well-known surfactant for emulsification can be used. The amount of the surfactant to be added is preferably from 0.1 to 5%, more preferably from 0.5 to 2% by mass of the amount of the oil phase.

As the surfactant added to the water phase, a surfactant which does not cause precipitation or aggregation caused by a reaction with the protective colloid is appropriately selected from anionic and nonionic surfactants.

Preferable examples of the surfactant include sodium alkylbenzenesulfonate, sodium alkylsulfate, sodium dioctyl sulfosuccinate, and polyalkylene glycol (such as polyoxyethylene nonyl phenyl ether).

The oil phase containing the above-mentioned components and the water phase containing the protective colloid and the surfactant can be emulsified in a known ordinary means for emulsifying fine particles, such as high-speed stirring means or ultrasonic wave dispersing means. Specific examples of the means include a homogenizer, a Manton-Gaulin, an ultrasonic wave disperser, a dissolver, or a Kdmill. In order to promote the reaction for forming capsule walls after the emulsification, it is preferable to heat the emulsion to a temperature of 30 to 70° C. In order to prevent the aggregation between the capsules during the reaction, it is preferable to add water to the reaction system so as to lower the probability of collision between the capsules, or perform stirring sufficiently.

During the reaction, a dispersion for preventing the aggregation may be newly added. With the advance of the polymerization reaction, the generation of carbon dioxide is observed. The termination of the generation can be regarded as the end point of the capsule wall forming reaction. Usually, target microcapsules can be obtained by several hours reaction.

Composite Fine Particle

Using the same materials as those for manufacturing microcapsules, composite fine particles to be used in the invention can be manufactured as follows: first, for example, a dye precursor or a diazo compound, a polyvalent isocyanate compound, and other components as occasion demands are melted by heating and are mixed, and this mixture is emulsified in a water dispersible medium in which a protective colloid substance has been melted and contained; then a reactive substance such as polyamine is mixed if needed; after that, heating this emulsion makes these polymer forming materials to polymerize to make composite fine particles.

Specifically, as an example, after a dye precursor and a polyvalent isocyanate compound are heated and melted at temperatures of 30° C. to 100° C., the mixture is emulsified using an emulsifying agent. At that time, the emulsification is carried out at the number of revolutions of 10,000 for 10 minutes or less. A known emulsifying agent may be used as the emulsifying agent, and particularly polyvinyl alcohol is preferable. Subsequently, the polyvalent isocyanate is polymerized at temperatures of 50° C. to 100° C. for 1 to 3 hours. After that, the dispersion liquid of composite fine particles can be prepared by cooling the polymerized mixture to room temperature.

As another example, there is such a method that a polyvalent isocyanate compound is used as a solvent, a solute containing a dye precursor is dissolved in the solvent and the obtained solution is emulsified in a hydrophilic colloidal aqueous solution, and consequently the dye precursor is involved in the polymerization of the polyvalent isocyanate compound. It is desirable to make the size of the composite fine particles minute in some degree in order to obtain sufficient coloring sensitivity and color density. When the particle size of the composite fme particles is too large, it is considered that heat is not transmitted to the center part of the composite fine particles and color forming becomes insufficient. The preferable particle size (average particle size) in the invention is smaller than 1 μm, more preferably 0.8 μm or less, and still more preferably 0.6 μm or less.

In addition, in the invention, the content ratio of the dye precursor contained in the composite fine particles is preferably 40% by mass or more, and more preferably 55% by mass or more, relative to the total mass of the composite fine particles, and the content ratio of the dye precursor contained in the composite fine particle is preferably 80% by mass or less, and more preferably 75% by mass or less, relative to the total mass of the composite fine particles. It is considered that a heat-sensitive recording substance having sufficient color forming ability can be obtained by containing a generous amount of the dye precursor.

When the electron-donating dye precursor is included in the heat-sensitive recording layer of the heat-sensitive recording material, the content of the precursor is preferably from 0.1 to 5.0 g/m$^2$, more preferably from 1.0 to 4.0 g/m$^2$. When the photolytic diazo compound is included in the heat-sensitive recording layer of the heat-sensitive recording material, the content of the photolytic diazo compound is preferably from 0.02 to 5.0 g/m$^2$, more preferably from 0.10 to 4.0 g/m$^2$ from the viewpoint of the color density thereof.

When the content of the electron-donating dye precursor is within the range of 0.1 to 5.0 g/m$^2$, a sufficient color density can be obtained. When the contents of the electron-donating dye precursor or the photolytic diazo compound is 5.0 g/m$^2$ or less, a sufficient color density can be obtained and the transparency of the heat-sensitive recording layer can be maintained.

Emulsion of Electron-Accepting Compound or Coupler

When capsules or composite fine particles containing an electron-donating dye precursor or a photolytic diazo compound as a core substance are made, the electron-accepting compound or the coupler to be used can be dispersed in a solid state together with, for example, a water-soluble high polymer, an organic base, an other color forming auxiliary agent and the like by the means such as a sand mill, and can be used, and it is more preferable that after an electron-accepting compound or a coupler is dissolved in advance in a high boiling point organic solvent which is hardly soluble or insoluble in water, this solution is mixed with an aqueous high polymer solution (water phase) containing a surfactant and/or a water-soluble high polymer as a protective colloid and emulsified with a homogenizer or the like, and thus prepared emulsion is used. In this case, a low boiling point solvent can be used as a dissolving auxiliary agent as occasion demands.

Further, a coupler and an organic base can be emulsified and dispersed separately, and they can also be dissolved in a high boiling point organic solvent after mixing and then be emulsified and dispersed. The preferable particle size of the emulsified dispersion is 1 μm or less.

The high boiling point organic solvent used in this case can be appropriately selected from the high boiling point oils described in JP-A No. 2-141279, the disclosure of which is incorporated by reference herein.

Among the oils, it is preferable to use esters from the viewpoint of the emulsification stability of the resultant emulsion. Among the esters, tricresyl phosphate is particularly preferable. The above oils may be used in any combination thereof, or the oil(s) may be used simultaneously with an oil other than the above oils.

The water-soluble polymer contained as the protective colloid can be appropriately selected from known anionic polymers, nonionic polymers and amphoteric polymers. The water-soluble polymer has a solubility in water of preferably 5% or more at a temperature at which the emulsification is conducted. Specific examples of the water-soluble polymer include: polyvinyl alcohol and modified products thereof; polyacrylic amide and derivatives thereof; ethylene-vinyl acetate copolymer; styrene-maleic anhydride copolymer;

ethylene-maleic anhydride copolymer; isobutylene-maleic anhydride copolymer; polyvinyl pyrrolidone; ethylene-acrylic acid copolymer; vinyl acetate-acrylic acid copolymer; cellulose derivatives such as carboxymethylcellulose and methylcellulose; casein; gelatin; starch derivatives; gum arabic; and sodium alginate.

Among these polymers, polyvinyl alcohol, modified products of polyvinyl alcohol, gelatin, modified product of gelatin, and cellulose derivatives are particularly preferable.

The mixing ratio of the oil phase to the water phase (the mass of the oil phase/the mass of the water phase) is preferably from 0.02 to 1.0, more preferably from 0.1 to 0.6. When the mixing ratio is within the range of 0.02 to 1.0, the coating liquid has an appropriate viscosity and excellent production suitability and coating stability.

When the electron-accepting compound is included in the heat-sensitive recording material of the invention, the amount of the electron-accepting compound is preferably from 0.5 to 30 parts by mass, more preferably from 1.0 to 10 parts by mass, per 1 part by mass of the electron-donating dye precursor.

When the coupler is included in the heat-sensitive recording material of the invention, the amount of the coupler is preferably from 0.1 to 30 parts by mass per 1 part by mass of the diazo compound.

Coating Liquid for Forming Heat-Sensitive Recording Layer

The coating liquid for forming the heat-sensitive recording layer can be prepared, for example, by mixing the microcapsule solution and the emulsion prepared as described above. The water-soluble polymer used as a protective colloid during the preparation of the microcapsule solution and the water-soluble polymer used as a protective colloid during the preparation of the emulsion function as binders in the heat-sensitive recording layer. A binder different from the protective colloids may be further added during the preparation of the coating liquid for forming the heat-sensitive recording layer.

The binder to be further added is generally a water-soluble binder. Examples thereof include polyvinyl alcohol, hydroxyethylcellulose, hydroxypropylcellulose, epichlorohydrin-modified polyamide, ethylene-maleic anhydride copolymer, styrene-maleic anhydride copolymer, isobutylene-maleic anhydride-salicylic acid copolymer, polyacrylic acid, polyacrylic amide, methylol-modified polyacrylamide, starch derivatives, casein, and gelatin.

To the binders, an water-resistance imparting agent may be added in order to provide water resistance, and/or an emulsion made of a hydrophobic polymer, specific examples of which include styrene-butadiene rubber latex and acrylic resin emulsion, may be added.

When the coating liquid for forming the heat-sensitive recording layer is applied to a support, a known applying means used for water-based or organic solvent-based coating liquid is used. In this case, in order to apply the coating liquid for forming the heat-sensitive recording layer safely and uniformly and maintain the strength of the coating, at least one selected form the following can be included in the coating liquid in the case of the heat-sensitive recording material of the invention: methylcellulose, carboxymethylcellulose, hydroxyethylcellulose, starch, gelatin, polyvinyl alcohol, carboxy-modified polyvinyl alcohol, polyacrylamide, polystyrene or copolymers thereof, polyester or copolymers thereof, polyethylene or copolymers thereof, epoxy resin, acrylate type resin or copolymers thereof, methacrylate type resin or copolymers thereof, polyurethane resin, polyamide resin, and polyvinyl butyral resin.

Other components that can be used in the heat-sensitive recording layer will be described hereinafter.

Such other components can be appropriately selected, without particular limitation, in accordance with a purpose. Examples thereof include known additives such as a thermally-meltable material, an ultraviolet absorber, and an antioxidant.

The thermally-meltable material can be included in the heat-sensitive recording layer in order to improve the thermal responsiveness thereof.

Examples of the thermally-meltable material include am aromatic ether, a thioether, an ester, an aliphatic amide and an ureido. Examples of these compounds are described in JP-A Nos. 58-57989, 58-87094, 61-58789, 62-109681, 62-132674, 63-151478, 63-235961, 2-184489, 2-215585 etc, the disclosures of which are incorporated by reference herein.

Preferable examples of the ultraviolet ray absorber include benzophenone type ultraviolet ray absorbers, benzotriazole type ultraviolet ray absorbers, salicylic acid type ultraviolet ray absorbers, cyanoacrylate type ultraviolet ray absorbers, and oxalic acid anilide type ultraviolet ray absorbers. Examples thereof are described in JP-A Nos. 47-10537, 58-111942, 58-212844, 59-19945, 59-46646, 59-109055 and 63-53544, Japanese Patent Application Publication (JP-B) Nos. 36-10466, 42-26187, 48-30492, 48-31255, 48-41572, 48-54965 and 50-10726, and U.S. Pat. Nos. 2,719,086, 3,707,375, 3,754,919 and 4,220,711, the disclosures of which are incorporated by reference herein.

Examples of the antioxidant include hindered amine type antioxidants, hindered phenol type antioxidants, aniline type antioxidants, and quinoline type antioxidants. Examples thereof are described in JP-A Nos. 59-155090, 60-107383, 60-107384, 61-137770, 61-139481, 61-160287 etc, the disclosures of which are incorporated by reference herein.

The amount of each of such other components to be applied is preferably from about 0.05 to 2.0 g/m$^2$, more preferably from about 0.1 to 1.0 g/m$^2$. Such components may be included in the inside and/or the outside of the microcapsules.

The heat-sensitive recording layer is preferably such a heat-sensitive recording layer that the energy required for obtaining a saturated transmission density ($D_{T\text{-}max}$) is high, that is, the dynamic range is wide, for the purpose of suppressing defects resulting from a slight variance in the thermal conductivity of the thermal head and giving a high-quality image. It is preferable that the heat-sensitive recording material of the invention should comprise such a heat-sensitive recording layer and the heat-sensitive recording layer should have such a characteristic that a saturated transmission density ($D_{T\text{-}max}$) of 3.0 can be obtained at a thermal energy of 70 to 130 mJ/mm$^2$.

It is preferable that the heat-sensitive recording layer should be applied such that a dry application amount thereof, which is the amount of the layer after drying, will be from 1 to 25 g/m$^2$ and the thickness of the layer will be set to a thickness of 1 to 25 μm. A plurality of such heat-sensitive recording layers may be provided. In this case, the dry application amount of all the heat-sensitive recording layers is preferably from 1 to 25 g/m$^2$.

Back Layer

In an embodiment of the heat-sensitive recording material of the invention, at least one back layer containing a matting agent is preferably provided on the side opposite to the side having the heat-sensitive recording layer of the support from the viewpoint of giving the transportability and the prevention of light reflection. By forming the back layer in which that matting agent is added, tackiness between the surface and the reverse side is reduced and the sheet-feeding property is improved. Moreover, it is preferable to adjust the glossiness (measured at the angle of incident light of 20°) of the above-mentioned back layer to be 50% or less, and more preferably 30% or less.

Further, in the invention, the coefficient of static friction between the surface of the back layer and the recording surface is preferably 0.20 to 1.0 and the coefficient of dynamic friction is preferably 0.10 to 0.50. If the coefficient of static friction is less than 0.20 or the coefficient of dynamic friction is less than 0.10, the heat-sensitive recording material becomes easy to slip or to collapse when it is piled up, and the handling workability might be decreased. On the other hand, if the coefficient of static friction is over 1.0 or the coefficient of dynamic friction is over 0.50, the slipping property of the heat-sensitive recording material in the recording device and the like might decrease, and the transportability might be decreased. The coefficient of static friction is more preferably 0.25 to 0.70 and particularly preferably 0.30 to 0.50. And, the coefficient of dynamic friction is more preferably 0.15 to 0.40 and more preferably 0.20 to 0.30.

The coefficient of static friction and the coefficient of dynamic friction can be measured by the horizontal method in accordance with JIS P8147 (1994). In this measuring method, test pieces are combined so that the protective layer surface and the back layer surface of the heat-sensitive recording material are contacted and their both sides of the length and the breadth are in the same direction. The movement speed of that test piece is 24.5 cm/minute and the test is carried out three times. Specifically, a sample that the humidity control has been carried out at the temperature of 23° C. and at the relative humidity of 60% RH for 24 hours is cut into the size of 6.3 cm×6.3 cm and the surface and the reverse side of the test pieces are combined, and the coefficient of friction is measured using a Peeling/Slipping/Scratching TESTER "HEIDON-14" (trade name) manufactured by HEIDON Corp., while the combined test piece is applied with the weight of 50 g and moved at the movement speed of 24.5 cm/minute.

The matting agents to be used in the invention include, in addition to fine particles such as fine particles of starch obtained from barley, wheat, corn, rice, and beans, cellulose fiber, fine particles of synthetic polymers such as polystyrene resin, epoxy resin, polyurethane resin, urea-formaldehyde resin, poly(meth)acrylate resin, polymethyl(meth)acrylate resin, copolymer resins of vinyl chloride, vinyl acetate or the like, and polyolefm, and fine particles of inorganic materials such as calcium carbonate, titanium oxide, kaolin, smectite clay, aluminum hydroxide, silica, and zinc oxide. The average particle size of that matting agent is preferably 0.5 to 20 μm, and more preferably 0.5 to 10 μm. Further, that matting agents may be used only in one kind, and two kinds or more of them may be used together.

Moreover, in case of a transmission heat-sensitive recording material, the refractive index of the above-mentioned back layer is preferably in the range of 1.4 to 1.8 from the viewpoint of making the transparency of the heat-sensitive recording material good. In addition, various kinds of dyes (for example, C.I. Pigment Blue 60, C.I. Pigment Blue 64, C.I. Pigment Blue 15:6, and the like) can be used in the back layer from the viewpoint of improving the hue. Further, a hardener may be used in the back layer. Examples of that hardeners include various kinds of hardners described in "THE THEORY OF THE PHOTOGRAPHIC PROCES; 4th EDITION" written by T. H. James (pp. 77 to 87), which is incorporated by reference herein in its entirety. Among them, vinyl sulfone compounds are preferable.

Support

In the heat-sensitive recording material of the invention, in case of a transmission heat-sensitive recording material, a transparent support is preferably used. Transparent supports include films of synthetic polymers such as polyester films of polyethylene terephthalate (PET), polybutylene terephthalate and the like, cellulose triacetate film, and polyolefin films such as polypropylene, polyethylene and the like. These films can be used alone, or two or more thereof may be pasted and used.

In case of medical application, the transparent support may be colored with a blue dye (for example, dye-1 described in Examples in JP-A No. 8-240877, which is incorporated by reference herein in its entirety), or may be uncolored. It is preferable to undercoat the support with gelatin, water-soluble polyester and the like. As for the undercoat layer, those described in JP-A Nos. 51-11420, 51-123139, and 52-65422, which are incorporated by reference herein in their entirety, are available. The thickness of the support is preferably 25 to 250 μm, and more preferably 50 to 210 μm.

The polymer film may be colored in any color hue. Examples of the method for coloring the polymer film include: a method of mixing a dye with a resin, kneading the mixture, then molding the kneaded mixture into a film; and a method of preparing a coating liquid in which a dye is dissolved in a suitable solvent, and applying this solution to a colorless and transparent resin film by a known coating method such as a gravure coating, roller coating or wire coating method. Among them, preferable is a method of molding a polyester resin, such as polyethylene terephthalate or polyethylene naphthalate, including a blue dye uniformly, into a film, and then subjecting this film to heat-resistance providing treatment, drawing treatment and antistatic treatment.

In particular, when the transparent heat-sensitive recording material of the invention on a schaukasten is observed from the side of the support, schaukasten light transmitting transparent non-image portions of the recording material may dazzle the observer to inhibit recognition of the image.

In order to avoid this situation, it is particularly preferable to use, as the transparent support, a synthetic polymer film colored in blue color which is in a square whose four vertexes are A (x=0.2805, y=0.3005), B (x=0.2820, y=0.2970), C (x=0.2885, y=0.3015), D (x=0.2870, y=0.3040) on chromaticity coordinates defined by the method described in JIS-Z8701, which is incorporated by reference herein in its entirety.

The invention is not limited to the transmission heat-sensitive recording materials as mentioned above. As the support, consequently known supports in the past such as paper, paperboard, pigment coated paper, synthetic paper, white polyester film, and thermoplastic resin laminated paper (what is called resin coated paper) can also be used. Further, in case of a multicolored heat-sensitive recording material, resin coated paper, synthetic paper, white polyester film, or supports preferably used in transmission heat-sensitive recording materials are preferable.

Other Layers

In the heat-sensitive recording material of the invention, on a support as mentioned above, an intermediate layer, an undercoat layer, an ultraviolet rays filter layer, a light transmissivity adjusting layer, and the like can be prepared as other layers.

The intermediate layer is preferably formed on the heat-sensitive recording layer. That intermediate layer is provided to prevent the mixing of the layers and to block a gas (such as oxygen) harmful to image storability. A binder to be used is not particularly limited, and polyvinyl alcohol, gelatin, polyvinyl pyrrolidone, cellulose derivatives, and the like can be used according to the system. Among them, gelatin is excellent in such a property (setting property) that the aqueous solution has flowability at high temperatures, and it lost the flowability at low temperatures (for example, 35° C. or less) to gelate. For this reason, when plural layers are provided on the support by applying the coating liquid for each layer and drying it, in either a method that each of plural layers is applied and dried sequentially or a method that the multiple layers are applied and dried at a time by the extruding die method and the like, two adjacent layers are effectively prevented from mixing mutually. As a result, the surface state of the obtained heat-sensitive recording material becomes good, and consequently a heat-sensitive recording material being possible to form a high-grade image can be obtained. From these reasons, the intermediate layer is suitable to the recording material for medical diagnosis in which a clear image should be formed to details. Further, because even if the intermediate layer is dried by high wind speed, the surface state does not be worsened, the manufacturing efficiency is improved.

As such a gelatin, either not modified (untreated) gelatin or modified (treated) gelatin can be used without any problem. Modified gelatins include gelatin treated with lime, gelatin treated with acid, phthalate treated gelatin, deionization treated gelatin, and low molecular weight gelatin treated with oxygen. Moreover, any of various kinds of surfactants may be added to give coatability. In addition, in order to further improve the gas barrier property, layered inorganic fine particles such as mica may be added in the range of 2 to 20% by mass to the binder, and more preferably in the range of 5 to 10% by mass. The concentration of a binder in the coating liquid for the intermediate layer is suitable to be 3 to 25% by mass, and more preferably about 5 to 15% by mass. Further, the dry application amount of the intermediate layer is suitable to be 0.5 to 6 g/m$^2$, and preferably 1 to 4 g/m$^2$.

In the heat-sensitive recording material of the invention, for the purpose of preventing the peeling off of the heat-sensitive recording layer from the support, an undercoat layer can be provided before applying a heat-sensitive recording layer containing microcapsules and the like, a layer for preventing light reflection, and the like. In that undercoat layer, acrylic ester copolymers, polyvinylidene chloride, SBR, aqueous polyester, and the like can be used. The thickness of the layer is preferably 0.05 to 0.5 μm.

When the heat-sensitive recording layer is applied on the undercoat layer, because the undercoat layer might be swelled with water contained in the coating liquid for the heat-sensitive recording layer to worsen the image recorded in the heat-sensitive layer, the undercoat layer is preferably hardened using any of hardners such as dialdehydes (for example, glutaric aldehyde and 2,3-dihydroxy-1,4-dioxane) and boric acid. The amount of these hardeners added may be in the range of 0.2 to 3.0% by mass according to the mass of the material of the undercoat layer. The hardner may be suitably added according to the desired hardness.

In the heat-sensitive recording material of the invention, a light shielding layer may be provided to prevent color fading of an image with light and fogging. The light shielding layer is a layer in which ultraviolet absorbent is uniformly dispersed in a binder. Color change in the surface, and color change or fading in the image part cased by ultraviolet rays can be prevented by effectively absorbing ultraviolet rays with this uniformly dispersed ultraviolet absorbent. As for the method of making the light shielding layer and compounds and the like to be used, ultraviolet absorbents such as benzotriazoles, benzophenones, and hindered amines, those described in JP-A No. 4-197778, which is incorporated by reference herein in its entirety, can be used.

Light Transmissivity Adjusting Layer

When the invention is applied to a multicolored heat-sensitive recording material, it is desirable to provide a light transmissivity adjusting layer as an upper layer of the heat-sensitive recording layer as occasion demands. About the above-mentioned light transmissivity adjusting layer, some descriptions are described in JP-A Nos. 9-39395, 9-39396, and 9-95487 which are incorporated by reference herein in their entirety, and the like.

When a component that functions as a precursor of the ultraviolet adsorbent is used in the light transmissivity adjusting layer, since the precursor does not function as an ultraviolet absorbent and has high light transmissivity before irradiation with light in the range of wavelengths necessary for fixing, in case of fixing a light fixing type heat-sensitive recording layer, the precursor can sufficiently transmit light in the range of wavelengths necessary for fixing and has the high transmissivity of visible light, so no hindrance will be caused in fixing the heat-sensitive recording layer.

On the other hand, after application of light in the range of wavelengths necessary for the light fixing (the photodecomposition of a photolytic diazo compound by irradiation with light) of the light fixing type heat-sensitive recording layer, the ultraviolet absorbent precursor reacts with that light to function as a ultraviolet absorbent. The greater part of light in the range of the wavelengths of ultraviolet rays is absorbed by this ultraviolet absorbent and the transmissivity of the light is lowered, which will be possible to improve the light stability of the heat-sensitive recording material. However, since the visible light does not be absorbed, the transmissivity of the visible light is substantially not changed.

At least one layer of the light transmissivity adjusting layer can be provided in the heat-sensitive recording material. Particularly, it is preferable to form the light transmissivity adjusting layer between the heat-sensitive recording layer and the protective layer. Moreover, the protective layer preferably may also have the function of the light transmissivity adjusting layer and the protective layer may be also used for the light transmissivity adjusting layer.

Method for Manufacturing Heat-Sensitive Recording Material Hereinafter, the method for manufacturing a heat-sensitive recording material of the invention will be described.

The method for manufacturing a heat-sensitive recording material of the invention may include applying a coating liquid for forming a heat-sensitive recording layer onto a support to form a heat-sensitive recording layer, and applying a coating liquid for forming a protective layer on the heat-sensitive recording layer to form a protective layer, and the method may further include forming other layers as occasion demands. In the method, the forming of the protective layer include dispersing a compound represented by Formulae (1) and/or a compound represented by Formula (2) in an aqueous solution of a high-molecular weight compound by solid dispersion or emulsion dispersion to form a dispersion liquid (dispersion process), and applying a coating liquid containing the dispersion liquid on the support (application process).

The dispersion process is the process where a compound represented by Formulae (1) and/or a compound represented by Formula (2) are dispersed by the above-described method for dispersing compounds represented by Formulae (1) and compounds represented by Formula (2) to give a dispersion liquid.

On the other hand, the application process is the process where the dispersion liquid obtained by the above-mentioned dispersion process is applied by any one of the known application methods including the blade application method, the air-knife application method, the gravure application method, the roller coating application method, the spray application method, the dip application method, and the bar application method. Here, the heat-sensitive recording layer and protective layer may be formed at the same time. In that case, the heat-sensitive recording layer and the protective layer thereon can be formed at the same time by multilayer coating of the coating liquid for forming the heat-sensitive recording layer and the coating liquid for forming the protective layer at the same time.

As the support to be used here, the support to be used in the heat-sensitive recording material of the invention can be used. Moreover, as the coating liquid for forming the heat-sensitive recording layer, the above described coating liquid for forming the heat-sensitive recording layer can be used. Further, also as the coating liquid for forming the protective layer, the above described coating liquid containing a pigment and a binder for forming the protective layer can be used. And, as other layers, layers such as the intermediate layer and the undercoat layer may be formed.

In the method for manufacturing the heat-sensitive recording material of the invention, known application methods such as the blade application method, the air-knife application method, the gravure application method, the roller coating application method, the spray application method, the dip application method, and the bar application method are used to form the undercoat layer, the heat-sensitive recording layer, the intermediate layer, the protective layer and the like sequentially. According to the method for manufacturing a heat-sensitive recording material of the invention, the heat-sensitive recording material of the invention can be easily and surely manufactured.

Recording Method

The recording method of the invention is a recording method in which recording is performed on the heat-sensitive recording material of the invention by the use of a thermal head.

The recording method of the invention will be described about the case of being applied on a multicolored heat-sensitive recording material.

As for the process for recording an image, for example, when the heat-sensitive recording material includes a diazo heat-sensitive recording layer containing a photolytic dizao compound, which is a heat-sensitive recording layer, the process may be as follows: when the surface of the side having a diazo heat-sensitive recording layer of the heat-sensitive recording material is heated imagewise with a thermal head, at the heated part of the dizao heat-sensitive recording layer, the capsule wall containing polyurea and/or polyurethane in the layer softens and becomes to be material permeable, a coupler and a basic material (an organic base) outside the capsule infiltrates within the microcapsules, and colors are formed imagewise to form an image. In this case, after the color formation, through irradiation with light corresponding to the absorption wavelength of the photolytic diazo compound (light fixing), the photolytic dizao compound causes the decomposition reaction and loses reactivity with the coupler, and as a result, the image can be fixed. Because the unreacted photolytic diazo compound causes the decomposition reaction and loses the activity by the light fixing, it is possible to suppress the variation in density of the image formed, the coloring owing to the generation of stain in the non image part (untreated surface part), that is, the lowering in whiteness, and the lowering in the image contrast owing to that lowering in whiteness.

The light sources to be used in the above-mentioned light fixing include various sorts of light-emitting diodes, a fluorescent lamp, a xenon lamp, and a mercury lamp. It is preferable in the point of being possible to fix at high efficiency that the emission spectrums of these light sources are almost corresponding to the absorption spectrums of the photodelytic dizao compound in the heat-sensitive recording material. Moreover, light-emitting diodes are preferable from the viewpoint of the temporal stability of the light settling. The heating may be carried out with a thermal head, and may be carried out using a heating roller.

Moreover, it is also possible to use the heat-sensitive recording material of the invention as an optical writing heat development type heat-sensitive recording material where imagewise writing is optically performed and the writing is thermally developed to form an image. In this case, the printing process is carried out by light source such as lasers in place of heating devices as mentioned above.

The heat-sensitive recording material of the invention may include two or more heat-sensitive recording layers, each forming a color in a different hue. A multicolored heat-sensitive recording material can be obtained by providing two or more heat-sensitive recording layers, each of which colors in a different hue.

Hereinafter, the recording process in the multicolored heat-sensitive recording material will be described.

When as heat-sensitive recording layers, C layer, B layer, and A layer are laminated in this order from the support, for example, recording can be carried out as below. The following is an example of using a multicolored heat-sensitive recording material having a third heat-sensitive recording layer (C layer) containing an electron-donating dye precursor and an electron-accepting compound on the support, a second heat-sensitive recording layer (B layer) containing a photolytic diazo compound with the maximum absorption wavelength of 365±30 nm, and a first heat-sensitive recording layer (A layer) containing a photolytic diazo compound with the maximum absorption wavelength of 445±50 nm. First, the first heat-sensitive recording layer (A layer) is heated, and the photolytic diazo compound and the coupler contained in the layer are made to react to form a color.

Next, by irradiation with light of 445±50 nm, the unreacted photolytic diazo compound contained in the first heat-sensitive recording layer (A layer) is decomposed. Then, sufficient heat to cause the second heat-sensitive recording layer (B layer) to form a color is given, and the photolytic diazo compound and the coupler contained in that layer are made to react to form a color. At this time, though the first heat-sensitive recording layer (A layer) is also strongly heated simultaneously, the photolytic diazo compound has already been decomposed and its color forming ability has been lost, so no color is formed. After that, by irradiation with light of 365±30 nm, the photolytic diazo compound contained in the second heat-sensitive recording layer (B layer) is decomposed. Lastly, sufficient heat to cause the third heat-sensitive recording layer (C layer) to form a color is given and the layer forms a color. At this time, though the first and second heat-sensitive recording layers are also strongly heated simultaneously, the photolytic diazo compound has already been decomposed and its color forming ability has been lost, so no color is formed.

When as heat-sensitive recording layers, C layer, B layer, and A layer are laminated in this order from the support, as coloring hues, the combinations of cyan/magenta/yellow, magenta/cyan/yellow, and yellow/cyan/magenta from the support are preferable.

When as heat-sensitive recording layers, C layer, A layer, and B layer are laminated in this order from the support, as coloring hues, the combinations of cyan/yellow/magenta, magenta/yellow/cyan, and yellow/magenta/cyan from the support are preferable.

Kinds of Thermal Heads

Because the specific lubricant is contained in the protective layer, the heat-sensitive recording material of the invention is excellent in abrasion resistance, and the surface energy thereof is low. Furthermore, the heat-sensitive recording material of the invention has a sufficient head matching property to a thermal head having a top layer that has a carbon ratio of 70% or more, further 75% or more, and particularly 90% or more, which kind of thermal head has the defects that surface energy is low and the lubricant contained in the protective layer in the heat-sensitive recording layer is hard to wet at the time of recording. For this reason, the heat-sensitive recording material of the invention is suitably used in fields where high image quality is demanded such as in medical recording mediums. In a certain embodiment, for example, a thermal head of 75% or more in carbon ratio may be used.

EXAMPLES

Hereinafter, the invention will be described concretely by examples. However, the invention should not be limited by these examples. Further, in the following, "%" means "% by mass" unless otherwise specifically indicated.

Example 1

(Preparation of the Coating Liquid of Pigment for the Protective Layer)

(1) In 900 g of water, 280 g of aluminum hydroxide surface-treated with stearic acid (trade name: "HIGILITE H42S", manufactured by Showa Denko KK) was added as a pigment and stirred for three hours. After that, 8.5 g of a dispersion auxiliary agent (trade name: "POIZ 532A", manufactured by Kao Corporation), 300 g of 10% aqueous solution of polyvinyl alcohol (trade name: PVA 105, manufactured by Kuraray Co., Ltd.), and 75 g of the 2% aqueous solution of a compound represented by the following formula [100] were added and dispersed with a sand mill to be 0.33 μm in average particle size, and then the concentration was adjusted to be 18% by adding water. Thus, the coating liquid of pigment for the protective layer was obtained.

[100]

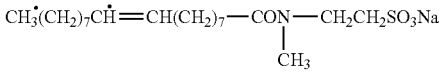

Further, the above-mentioned average particle size was measured according to the following procedure: the pigment to be used was dispersed in the presence of a dispersant, and just after that, the pigment dispersion was so diluted with water as to be 0.5%. Thus prepared test liquid was poured in the warm water of 40° C. and adjusted to be 72±1% in light transmissivity, and then the solution was subjected to ultrasonication for 30 seconds, and the average particle size was measured by a laser diffraction particle size distribution measuring device manufactured by Horiba, Ltd. (trade name: LA 700). The average particle size of pigment particles corresponding to 50% by volume of all pigments was indicated as the average particle size. All the average particle sizes described below indicate the average particle size measured by the same method.

(2) Preparation of the Lubricant Dispersion Liquid—1 for the Protective Layer.

In 280 g of water, 110 g of glycerin tri-12-hydroxystearate (trade name: K3 Wax 500, manufactured by Kawaken Fine Chemicals Co., Ltd.) was added as a lubricant and stirred for three hours. After that, 3 g of a dispersion auxiliary agent (trade name: POIZ 532A, manufactured by Kao Corporation), 340 g of 10% aqueous solution of polyvinyl alcohol (trade name: MP 103, manufactured by Kuraray Co., Ltd.), and 34 g of the 2% aqueous solution of a compound represented by formula [100] were added and dispersed with a sand mill to be 0.26 μm in average particle size, and then the concentration of solid content was adjusted to be 18% by adding water. Thus, the lubricant dispersion liquid—1 for the protective layer was obtained. Here, the concentration of glycerin tri-12-hydroxystearate, which is a lubricant, is 13.6%.

(3) Preparation of the Lubricant Dispersion Liquid—2 for the Protective Layer.

In 6.4 g of water, 0.44 g of a dispersion auxiliary agent (trade name: POIZ 532A, manufactured by Kao Corporation), 83 g of 5.8% aqueous solution of polyvinyl alcohol (trade name: MP 103, manufactured by Kuraray Co., Ltd.), and 5.3 g of the 2% aqueous solution of a compound represented by formula [100] were added, and then 15.3 g of the above-mentioned exemplary compound A-08 was added and dispersed with a sand mill to be 0.45 μm in average particle size. Thus, the lubricant dispersion liquid—2 with the concentration of solid content of 18.6% for the protective layer was obtained. Here, the concentration of A-08, which is a lubricant, is 13.9%.

(4) Preparation of the Coating Liquid A for the Protective Layer.

As the coating liquid for the protective layer,

5% aqueous solution of polyvinyl alcohol : 641.2 g
(trade name: PVA 124C, manufactured by Kuraray Co., Ltd.),
72% aqueous solution of sodium dodecylbenzenesulfonate: 10.7 g,
50% aqueous solution of an acetylene glycol surfactant: 11.4 g
(trade name: SURFYNOL 104E, manufactured by Nisshin Chemical Co., Ltd.),
fluorine type surfactant
(trade name: SURFRON S131S, manufactured by Asahi Glass Co., Ltd.): 21.3 g,
Polyoxyethylene alkylphosphate : 4.1 g, (PLYSURF A217E, manufactured by Dai-ichi Kogyo Seiyaku Co., Ltd., melting point is 35° C.),
the above-mentioned pigment dispersion liquid for the protective layer: 512.2 g,
the above-mentioned lubricant dispersion liquid—1 for the protective layer: 19.7 g,
the above-mentioned lubricant dispersion liquid—2 for the protective layer: 77.3 g,
20.5% zinc stearate dispersion liquid: 44.3 g
(trade name: F115, manufactured by Chukyo Yushi Co., Ltd.),
18% stearic acid dispersion liquid: 65.8 g (trade name: SEROZOLE 920, manufactured by Chukyo Oil and Fat Co., Ltd.), 35% silicone oil water dispersion: 88.9 g (trade name: BY22-840, manufactured by Dow Corning Toray Silicone Co., Ltd.), 5% aqueous solution of styrene-maleic acid copolymer ammonium salt: 235.5 g (trade name: POLYMALON 385, manufactured by Arakawa Chemical Industries Ltd.), 20% colloidal silica: 113.4 g (trade name: SNOWTEX O, manufactured by Nissan Chemical Industries, Ltd.), 4% aqueous solution of boric acid: 228.5 g, 2% aqueous solution of acetic acid: 30.8 g, the compound of the following formula [002] (50% aqueous solution): 32.5 g are mixed, and the concentration was adjusted to be 12% by adding water and the objective coating liquid A for the protective layer was obtained.

[002]

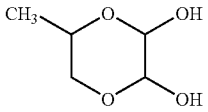

(Preparation of the Coating Liquids for the Heat-Sensitive Recording Layer)

According to the following procedure, the microcapsule liquid having an electron-donating dye precursor as the core substance and the emulsion of an electron-accepting compound are each prepared.

(1) Preparation of the Microcapsule A Liquid.

As an electron-donating dye precursor, 63.7 g of the compound represented by the following structural formula [201], 21 g of the compound represented by the following structural formula [202], 10.8 g of the compound represented by the following structural formula [203], 5.8 g of the compound represented by the following structural formula [204], 2.2 g of the compound represented by the following structural formula [205], 2.7 g of the compound represented by the following structural formula [206], and 2.6 g of the compound represented by the following structural formula [207] were added in 110 g of ethyl acetate and the mixture was heated to 70° C. and dissolved. Then, the solution was cooled to 45° C. In this solution, 70 g of a capsule wall material (trade name: TAKENATE D140N, manufactured by Mitsui Takeda Chemicals Inc.) was added and mixed.

After this solution was added in the aqueous phase of 300 g of 5.9% aqueous solution of polyvinyl alcohol (trade name: MP-103, by Kuraray Co., Ltd.), the mixture was emulsified using a dissolver (trade name: TK ROBOMIX, manufactured by Tokushu Kika Kogyo Co., Ltd.). After 275 g of water and 6.5 g of tetraethylenepentamine were added in the obtained emulsion, the encapsulation reaction was carried out at 60° C. for 4 hours. Lastly, the concentration was adjusted with water to be 25% and thus the microcapsule liquid A of 0.8 μm in average particle size was obtained.

(2) Preparation of the Microcapsule B Liquid.

As an electron-donating dye precursor, 54.5 g of the compound represented by the following structural formula [201], 14.8 g of the compound represented by the following structural formula [202], 10.5 g of the compound represented by the following structural formula [203], 6.4 g of the compound represented by the following structural formula [204], 3.4 g of the compound represented by the following structural formula [205], 0.5 g of the compound represented by the following structural formula [206], and 2.1 g of the compound represented by the following structural formula [207] were added in 110 g of ethyl acetate and the mixture was heated to 70° C. and dissolved. Then, the solution was cooled to 45° C. In this solution, 65.5 g of a capsule wall material (trade name: TAKENATE D127N, manufactured by Mitsui Takeda Chemicals Inc., Ltd.) was added and mixed.

After this solution was added in the aqueous phase of 275 g of 5.9% aqueous solution of polyvinyl alcohol (trade name: MP-103, by Kuraray Co., Ltd.), the mixture was emulsified and dispersed using the dissolver (trade name: TK ROBOMIX manufactured by Tokushu Kika Kogyo Co., Ltd.). After 275 g of water and 5.70 g of tetraethylenepentamine were added in the obtained emulsified liquid, the encapsulation reaction was carried out at 60° C. for 4 hours. Lastly, the concentration was adjusted with water to be 28% and thus the microcapsule liquid B of 0.3 μm in average particle size was obtained.

[201]

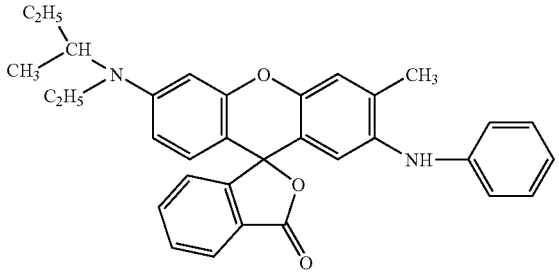

[202]

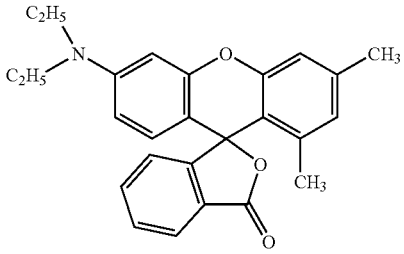

[203]

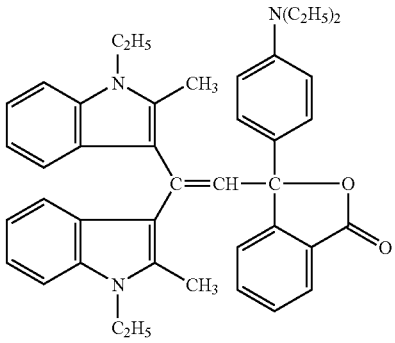

-continued

[204]

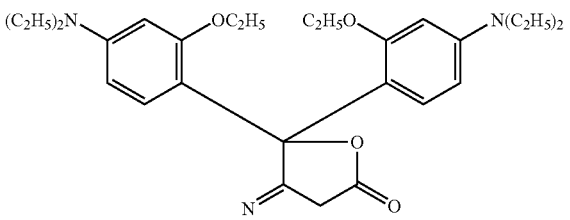

[205]

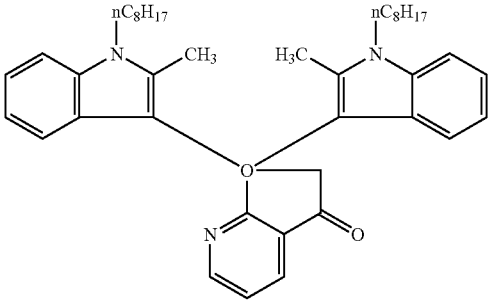

[206]

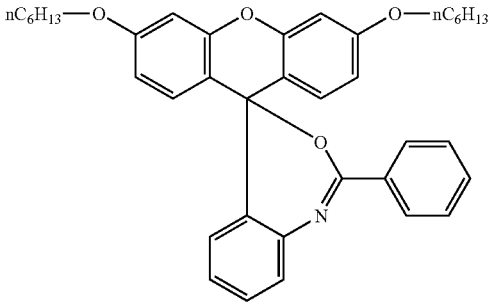

[207]

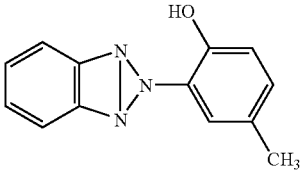

(3) Preparation of the Emulsion of an Electron-Accepting Compound.

As an electron-accepting compound, 220 g of the compound represented by the following structural formula [301], 80 g of the compound represented by the following structural formula [302], 26 g of the compound represented by the following structural formula [303], 26 g of the compound represented by the following structural formula [304], 4.8 g of the compound represented by the following structural formula [305], and 41 g of the compound represented by the following structural formula [306] were added together with 10 g of tricresyl phosphate and 5 g of diethyl maleate in 160 g of ethyl acetate and the mixture was heated to 70° C. and dissolved. After this solution was added in the aqueous phase where 1340 g of water, 43.5 g of polyvinyl alcohol (trade name: PVA 217C, manufactured by Kuraray Co., Ltd.), 29 g of polyvinyl alcohol (trade name: PVA 205C, manufactured by Kuraray Co., Ltd.), 110 g of 2% aqueous solution of the compound represented by the following structural formula [401], and 110 g of 2% aqueous solution of the compound represented by the following structural formula [402] has been mixed, the mixture was emulsified using the dissolver (TK Robomix manufactured by Tokushu Kika Kogyo Co., Ltd.) so as to be 0.7 μm in average particle size, and the concentration was adjusted with water to be 22%. Thus, the emulsion of an electron-accepting compound was obtained.

[301]

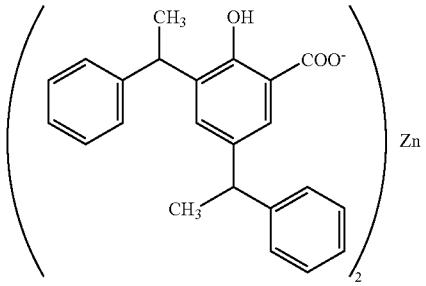

[302]

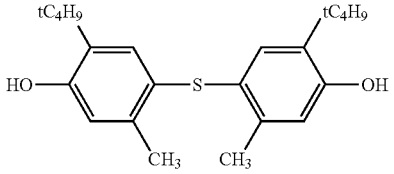

[303]

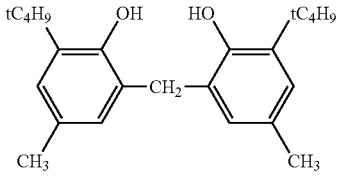

[304]

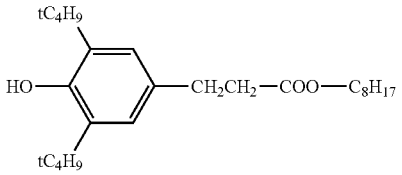

[305]

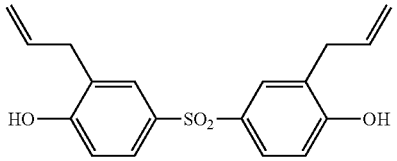

[306]

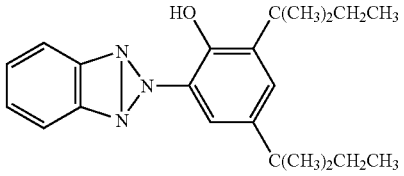

[401]

$C_{12}H_{25}SO_3Na$

[402]

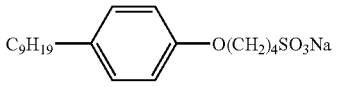

(4) Preparation of the Coating Liquid A for the Heat-Sensitive Recording Layer.

After 160 g of the above-mentioned microcapsule A liquid (the concentration of the solid content is 25%), 30 g of the above-mentioned microcapsule B liquid (the concentration of the solid content is 28%), 710 g of the above-mentioned emulsion of an electron-accepting compound (the concentration of the solid content is 22%), 7.2 g of 50% aqueous solution of the compound represented by the above-mentioned structural formula [002], and 25.5 g of colloidal silica (trade name: SNOWTEX O, manufactured by Nissan Chemical Industries, Ltd.) were mixed, the concentration was adjusted to be 21.5% with water and the objective coating liquid (A) for the heat-sensitive recording layer was prepared.

(5) Preparation of the Coating Liquid B for the Heat-Sensitive Recording Layer.

After 60 g of the above-mentioned microcapsule liquid A (the concentration of the solid content is 25%), 110 g of the above-mentioned microcapsule liquid B (the concentration of the solid content is 28%), 725 g of the above-mentioned emulsified dispersion of an electron-accepting compound (the concentration of the solid content is 22%), 6.5 g of 50% aqueous solution of the compound represented by the above-mentioned structural formula [002], and 23.5 g of colloidal silica (trade name: SNOWTEX O, manufactured by Nissan Chemical Industries, Ltd.) were mixed, the concentration was adjusted to be 21.5% with water and the objective coating liquid (B) for the heat-sensitive recording layer was prepared.

(Preparation of the Coating Liquid for the Intermediate Layer)

After 14500 g of water was added to 1 kg of lime treated gelatin and dissolved it, 137 g of 5% dissolution liquid of sodium di-2-ethylhexyl sulfosuccinate (NISSAN RAPISOL B90, manufactured by NOF Corporation) (mixed solvent of water/methanol=1/1 in volume), 25 g of 3.5% aqueous solution of 1,2-benzisothiazoline-3-on, and 1080 g of 3.0% poly (sodium p-vinylbenzenesulfonate) (molecular weight: about 400,000) were added and the objective coating liquid for the intermediate layer was prepared.

(Preparation of the Coating Liquid A for the Back Layer)

To the mixture of 1 kg of lime treated gelatin, 180 g of dispersion containing 12% by mass of spherical PMMA particles of 5.7 μm in average particle size and 4.5% by mass of gelatin, 1028 g of emulsion of ultraviolet absorber containing compounds represented by the following structural formulae [501] to [505] in the following rate of content [here, the content of ultraviolet absorber per 1 kg of that emulsion is 14.9 g for the compound represented by the structural formula [501], 12.7 g for the compound represented by the structural formula [502], 14.9 g for the compound represented by the structural formula [503], 21.1 g for the compound represented by the structural formula [504], and 44.5 g for the compound represented by the structural formula [505]], 0.98 g of 1,2-benzisothiazoline-3-on, 16.4 g of poly(sodium p-vinylbenzenesulfonate) (molecular weight: about 400,000), 3.79 g of the compound represented by the following structural formula [506], 1448 mL of 20% latex liquid of polyethyl acrylate, 52.2 g of N,N-ethylene-bis(vinylsulphonyl acetamide), and 17.4 g of 1,3-bis(vinylsulphonyl acetamine)propnane, water was added to adjust the total amount to be 21.03 liters and the objective coating liquid (A) for the back layer was prepared.

[501]

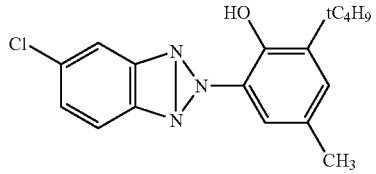

[502]

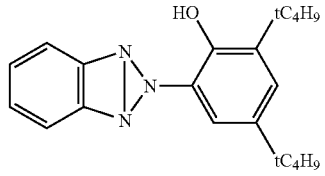

[503]

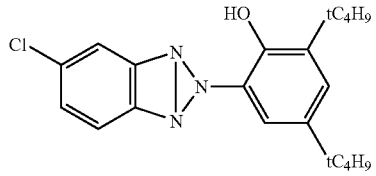

[504]

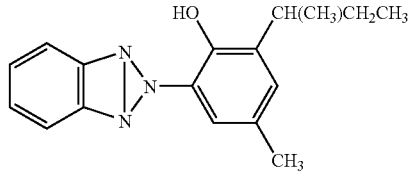

[505]

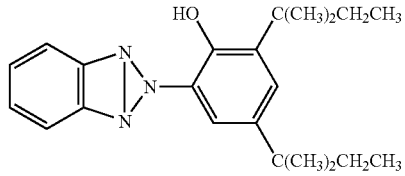

[506]

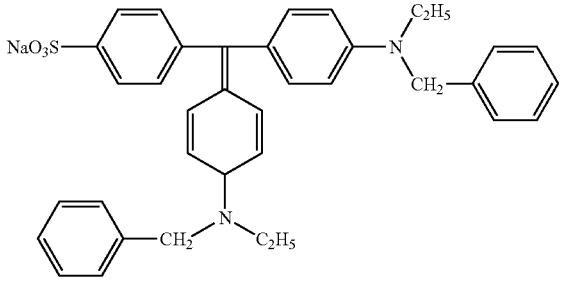

(Preparation of the Coating Liquid B for the Back Layer)

To the mixture of 1 kg of lime treated gelatin, 1015 g of dispersion containing 15% by mass of spherical PMMA particles of 0.7 μm in average particle size and 7.0% by mass of gelatin, 2.09 g of 1,2-benzisothiazoline-3-on, 9.53 g of sodium p-tert octylphenoxy polyoxyethylene ethylenesulfonate, 57.9 g of sodium polyacrylate (molecular weight: about 100,000), 22.9 g of poly(sodium p-vinylbenzenesulfonate) (molecular weight: about 400,000), 0.37 g of sodium N-propyl-N-polyoxyethylene-perfluorooctane sulfonamide butylsulfonate, 8.97 g of hexadecyloxy-nonyl(ethyleneoxy)-ethanol, 28.1 g of 1N caustic soda, 18.0 g M,M-ethylene-bis(vinylsulphonyl acetamide), and 6.0 g of 1,3-(vinylsulphonyl acetamine)propane, water was added to adjust the total amount to be 26.59 liters and the objective coating liquid (B) for the back layer was prepared.

(Manufacture of the Heat-Sensitive Recording Materials)

(1) Manufacture of the Back Layer.

A transparent PET support which had been colored in blue (thickness is 175 μm) was prepared in the point of X=0.2850 and Y=0.2995 in the chromaticity coordinates prescribed by the method described in JIS-Z8701, which are incorporated herein by reference in its entirety, and the above-mentioned coating liquid (A) for the back layer and the coating liquid (B) for the back layer were applied and dried on the support in a simultaneous multilayer coating manner in this order from the side near the support by the slide bead method so that the application amounts were 51.4 mL/m$^2$ and 14.7 mL/m$^2$, respectively. The application and drying conditions are as follows. The application speed was 160 m/minute, the distance between the head of the coating die and the support was 0.10 to 0.30 mm, and the pressure in the decompression chamber was set to be lower than atmospheric pressure by 200 to 900 Pa. Electricity on the support was removed with the ionic wind before the application. In the following chilling zone, after the coating liquid on the support was cooled with the wind of 10 to 20° C. in dry-bulb temperature, the support was transferred without touching and dried with the drying wind of 23 to 45° C. in dry-bulb temperature and of 15 to 21° C. in wet-bulb temperature by the helix noncontact type dryer.

(2) Manufacture of the Heat-Sensitive Recording Layer.

On the surface opposite to the back layer of the support on which the above-mentioned back layer had been applied, the above-mentioned coating liquid (A) for the heat-sensitive recording layer, the above-mentioned coating liquid (B) for the heat-sensitive recording layer, the above-mentioned coating liquid for the intermediate layer, and the above-mentioned coating liquid for the protective layer were applied and dried in in a simultaneous multilayer coating manner in this order from the side near the support by the slide bead method so that the application amounts were 49.4 mL/m$^2$, 21.3 mL/m$^2$, 24.7 mL/m$^2$, and 26.0 mL/m$^2$, respectively. The coating liquid for each layer was adjusted in the temperature range of 33° C. to 37° C. The above-mentioned drying conditions are as follows. The application speed was 160 m/minute, the distance between the head of the coating die and the support was 0.10 to 0.30 mm, and the pressure in the decompression chamber was set to be lower than atmospheric pressure by 200 to 1000 Pa. Electricity on the support was removed with the ionic wind before the application. In the following chilling zone, after having been dried with the wind of 45° C. to 55° C. in temperature and 0 to 5° C. in dew point, the support was transferred without touching and dried with the drying wind of 30 to 45° C. in dry-bulb temperature and of 17 to 23° C. in wet-bulb temperature by the helix noncontact type dryer. After drying, the support was subjected to humidity conditioning at the temperature of 25° C. and the humidity of 40 to 60%.

<Evaluation>Evaluation of Transport Torque

To the manufactured sample, the print pattern as shown in FIG. 1 which has one step of printing energy was 0.0 mJ/mm$^2$: 85 pixels and 24 steps of the printing energy of from 14.22 mJ/mm$^2$ up to 140.03 mJ/mm$^2$ at the pitch of 5.47 mJ/mm$^2$ was prepared with a thermal head KGT of 90% or more in carbon ratio (manufactured by Kyocera Corporation) under the conditions of the pressing force of the head of 10 kg and the transport speed of 7 mm/s. As for the measuring device and method, a torsion bar was connected between the platen roll and the motor for transport, and through the torsion bar, torque at all steps at the time of printing the above-mentioned image pattern was measured with a torquemeter (AMHERST, N.H. USA Vibrac lord torque measuring device II). The transport torque at the time of printing the steps 5, 9 and 15 of the pattern was evaluated, and results are shown in Table 1.

Example 2

A heat-sensitive recording material was manufactured and evaluated in the same way as that in Example 1, except that the above-mentioned exemplary compound A-08 which had been used in the preparation of the lubricant dispersion liquid—2 for the protective layer in Example 1 was replaced with the above-mentioned exemplary compound A-06 of the same amount of the solid content. The result is shown in Table 1.

Example 3

A heat-sensitive recording material was manufactured and evaluated in the same way as that in Example 1, except that the above-mentioned exemplary compound A-08 which had been used in the preparation of the lubricant dispersion liquid—2 for the protective layer in Example 1 was replaced with the above-mentioned exemplary compound A-32 of the same amount of the solid content. The resut is shown in Table 1.

Example 4

A heat-sensitive recording material was manufactured and evaluated in the same way as that in Example 1, except that the above-mentioned exemplary compound A-08 which had been used in the preparation of the lubricant dispersion liquid—2 for the protective layer in Example 1 was replaced with the above-mentioned exemplary compound A-38 of the same amount of the solid content. The result is shown in Table 1.

Example 5

A heat-sensitive recording material was manufactured and evaluated in the same way as in Example 1, except that the above-mentioned exemplary compound A-08 which had been used in the preparation of the lubricant dispersion liquid—2 for the protective layer in Example 1 was replaced with the above-mentioned exemplary compound A-26 of the same amount of the solid content. The result is shown in Table 1.

Example 6

A heat-sensitive recording material was manufactured and evaluated in the same way as in Example 1, except that the above-mentioned exemplary compound A-08 which had been used in the preparation of the lubricant dispersion liquid—2 for the protective layer in Example 1 was replaced with the above-mentioned exemplary compound A-23 of the same amount of the solid content. The result is shown in Table 1.

Comparative Example 1

A heat-sensitive recording material was manufactured and evaluated in the same way as in Example 1, except that the above-mentioned exemplary compound A-08 which had been used in the preparation of the lubricant dispersion liquid—2 for the protective layer in Example 1 was not added. The result is shown in Table 1.

TABLE 1

| | Lubricant | Torque by step (kg · cm) 5 | 9 | 15 |
|---|---|---|---|---|
| Example 1 | A-08 | 2.5 | 1.7 | 1.1 |
| Example 2 | A-06 | 3.4 | 2.4 | 1.8 |
| Example 3 | A-32 | 2.1 | 1.2 | 0.8 |
| Example 4 | A-38 | 3.3 | 2.2 | 1.7 |
| Example 5 | A-26 | 2.9 | 1.9 | 1.1 |
| Example 6 | A-23 | 2.9 | 1.8 | 1.1 |
| Comparative Example 1 | Not added | 3.8 | 2.7 | 2.1 |

Example 7

<Preparation of the Aqueous Solution of Gelatin Phthalate>

Thirty-two parts of gelatin phthalate (trade name: #801 gelatin, manufactured by Nitta Gelatine Inc.) and 368 parts of ion-exchange water were mixed and dissolved at 40° C., and thus the aqueous solution of gelatin phthalate was obtained.

<Preparation of the Aqueous Solution of Alkali Treated Gelatin>Alkali treated low ion gelatin (trade name: #750 gelatin, manufactured by Nitta Gelatine Inc.), 25.5 parts, 0.7286 parts of 1,2,-benzothiazoline-3-on (3.5% methanol solution, manufactured by Daito Chemical Industrial Co., Ltd.), 0.153 parts of calcium hydroxide, and 143.6 parts of ion-exchange water were mixed and dissolved at 50° C., and thus the aqueous solution of alkali treated gelatin for making an emulsion.

(1) Preparation of Yellow Heat-Sensitive Recording Layer Liquid

<Preparation of a Photolytic Diazo Compound Microencapsulated Liquid (a)>

To 17.6 parts of ethyl acetate, 3.3 parts of the following diazonium salt compound A (a photolytic diazo compound, the maximum absorption wavelength is 420 nm), 3.3 parts of the following diazonium salt compound B (a photolytic diazo compound, the maximum absorption wavelength is 420 nm), 10.4 parts of monoisopropylbiphenyl, 1.7 parts of diphenyl phthalate, 1.7 parts of 2-benzoyloxy benzoate phenyl, and 0.4 parts of diphenyl-(2,4,6-trimethybenzoyl)phosphine oxide (trade name: LUCIRIN TPO, manufactured by BASF Japan Ltd.) were added, and the mixture was heated to 40° C. and dissolved uniformly. In the above-mentioned mixed liquid, as capsule wall materials, 3.1 parts of the adduct of xylylene diisocyanate and trimethylolpropane (trade name: TAKENATE D110N (75% ethyl acetate solution), manufactured by Mitsui Takeda Chemical Co., Ltd.), and 4.8 parts of the mixture of the adduct of xylylene diisocyanate and trimethylolpropane and the adduct of xylylene diisocyanate and bisphenol A (trade name: TAKENATE D119N (50% ethyl acetate solution), manufactured by Mitsui Takeda Chemical Co., Ltd.) were added and stirred uniformly, and the mixed liquid (I) was obtained.

Separately, in 59.7 parts of the above-mentioned aqueous solution of gelatin phthalate, 11.5 parts of ion-exchange water, and 0.35 parts of alkylglucoside-based surfactant (trade name: SCRAPH AG-8 (50%); manufactured by Nippon Fine Chemical Co., Ltd.) were added and the mixed liquid (II) was obtained.

The mixed liquid (I) was added in the mixed liquid (II), and emulsified using the dissolver (TK ROBOMIX manufactured by Tokushu Kika Co., Ltd.) at 30° C. After 23 parts of water was added in the obtained emulsion and the mixture was uniformized, the mixture was stirred at 40° C. and the encapsulation reaction was continued for 3 hours while removing ethyl acetate. After this, 0.34 parts of 1,2-benzothiazoline-3-on (3.5% methanol solution, manufactured by Daito Chemical Industrial Co., Ltd.), 2.9 parts of an ion-exchange resin, AMBERLITE SWA 100-HG (trade name; manufactured by Organo Corporation), and 5.8 parts of AMBERLITE IRA 67 (trade name; manufactured by ROHM AND HAAS (UK) LIMITED) were added and stirred for further 1.5 hours. After that, the ion-exchange resins were removed by filtration and the concentration was adjusted so that the concentration of the solid content in the capsule liquid became 20% and the photolytic diazo compound encapsulated liquid (a) was obtained. The particle size of the obtained microcapsule was 0.46 μm in median size, as the result of the particle size measurement (performed with LA-700, manufactured by Horiba, Ltd.).

Diazonium salt compound A

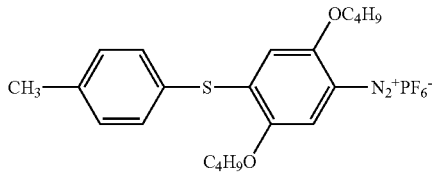

Diazonium salt compound B

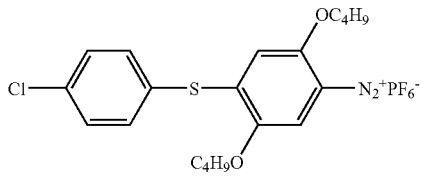

<Preparation of the Emulsion (a) of a Coupler Compound>

In 33.0 parts of ethyl acetate, 9.9 parts of the following coupler compound C, 9.9 parts of triphenylguanidine (manufactured by Hodogaya Chemical Co., Ltd.), 20.8 parts of 4,4'-(m-phenylenediisopropylidene)diphenol (trade name: bisphenol M, (manufactured by Mitsui Petrochemical Industries, Ltd.)), 3.3 parts of 3,3,3',3'-tetramethyl-5,5',6',6'-tetra (1-propyloxy)-1,1'-spirobisindan, 13.6 parts of 4-(2-ethylhexyloxy)benzenesulfonamide (manufactured by Manac Inc.), 6.8 parts of 4-n-pentyloxy benzenesulfonamide (manufactured by Manac Inc.), and 4.2 parts of calcium dodecylbenzenesulfonate (trade name: PIONIN A-41-C, 70% methanol solution, manufactured by Takemoto Oil Fat Co., Ltd.) were dissolved, and the mixed liquid (III) was obtained.

Separately, 107.3 parts of ion-exchange water was mixed in 206.3 parts of the above-mentioned aqueous solution of alkali treated gelatin, and the mixed liquid (IV) was obtained.

The mixed liquid (III) was added in the mixed liquid (IV), and emulsified using the dissolver (TK ROBOMIX manufactured by Tokushu Kika Kogyo Co., Ltd.) at 40° C. After the obtained coupler compound emulsion was depressurized and heated to remove ethyl acetate, the concentration was adjusted so that the concentration of the solid content became 26.5%. The particle size of the obtained coupler compound emulsion was 0.21 μm in median size, as the result of the particle size measurement (performed with LA-700, manufactured by Horiba, Ltd.).

Further, to 100 parts of the above-mentioned coupler compound emulsion, 9 parts of SBR latex (trade name: SN-307, 48% liquid, manufactured by Sumitomo ABS Latex Co., Ltd.) the concentration of which had been adjusted to be 26.5% was added and stirred uniformly, and the coupler compound emulsion (a) was obtained.

Coupler compound C

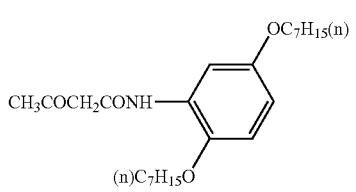

<Preparation of the Coating Liquid (a) for the Heat-Sensitive Recording Layer>

The above-mentioned photolytic diazo compound microencapsulated liquid (a) and the above-mentioned coupler compound emulsion (a) were mixed so that the mass ratio of encapsulated coupler compound/diazo compound became 2.2/1, and the coating liquid (a) for the heat-sensitive recording layer was obtained.

(2) Preparation of the Magenta Heat-Sensitive Recording Layer Liquid

<Preparation of the Photolytic Diazo Compound Microencapsulated Liquid (b)>

In 12.8 parts pf ethyl acetate, 3.8 parts of the following photolytic diazo compound D (the maximum absorption wavelength is 365 nm), 7.6 parts of isopropylbiphenyl, 2.0 parts of tricresyl phosphate, 1.1 parts of dibutyl sulfate, 0.38 parts of 2,4,6-trimethylbenzoyl ethylester phenylphosphinate (trade name: LUCIRIN TPO-L, manufactured by BASF Co., Ltd.), and 0.07parts of calcium dodecylbenzenesulfonate (trade name: PIONIN A-41-C, 70% methanol solution, manufactured by Takemoto Oil Fat Co., Ltd.) were added, and the mixture was heated and dissolved uniformly.

In the above-mentioned mixed liquid, as a capsule wall material, 10.9 parts of the adduct of xylylene diisocyanate and trimethylolpropane (trade name: TAKENATE D110N (75% ethyl acetate solution), manufactured by Mitsui Takeda Chemicals Inc., Ltd.) was added and stirred uniformly, and the mixed liquid (V) was obtained.

Separately, in 59.9 parts of the above-mentioned aqueous solution of gelatin phthalate, 22.8 parts of ion-exchange water, and 0.31 parts of 25% aqueous solution of sodium dodecylbenzenesulfonate (trade name: NEOPELEX F-25, manufactured by Kao Corporation) were added and the mixed liquid (VI) was obtained.

The mixed liquid (V) was added in the mixed liquid (VI), and emulsified using the dissolver (TK ROBOMIX manufactured by Tokushu Kika Kogyo Co., Ltd.) at 30° C. After 29.1 parts of water was added in the obtained emulsion and the mixture was uniformized, the uniform mixture was stirred at 40° C. and the encapsulation reaction was continued for 2 hours while removing ethyl acetate. After that, 0.28 parts of 1,2-benzothiazoline-3-on (3.5% methanol solution, manufactured by Daito Chemical Industrial Co., Ltd.) was added.

After this, 1.16 parts of an ion-exchange resin, AMBERLITE IRA 67 (manufactured by Organo Corporation), and 2.33 parts of AMBERLITE SWA 100-HG (manufactured by Organo Corporation) were added and stirred for further 20 minutes. After that, the ion-exchange resins were removed by filtration and the concentration was adjusted so that the concentration of the solid content became 18.5% and the photolytic diazo compound microencapsulated liquid (b) was obtained. The particle size of the obtained microcapsule was 0.57 μm in median size, as the result of the particle size measurement (performed with LA-700, manufactured by Horiba, Ltd.).

Diazonium salt compound D

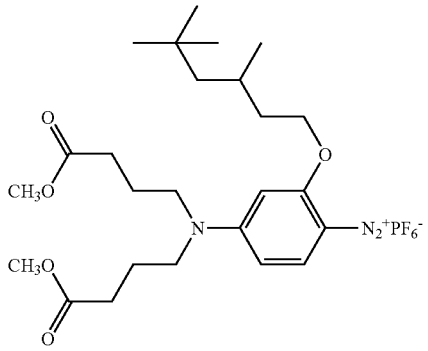

<Preparation of the Emulsion (b) of a Coupler Compound>

In 36.9 parts of ethyl acetate, 6.3 parts of the following coupler compound E, 14.0 parts of triphenylguanidine (manufactured by Hodogaya Chemical Co., Ltd.), 14.0 parts of 4,4'-(m-phenylenediisopropylidene)diphenol (trade name: bisphenol M, (manufactured by Mitsui Petrochemical Industries, Ltd.)), 14 parts of 1,1-(p-hydroxyphenyl)-2-ethylhexane, 3.5 parts of 3,3,3',3'-tetramethyl-5,5',6,6'-tetra(1-propyroxy)-1,1-spirobisindan, 3.5 parts of the following compound (G), 1.7 parts of tricresyl phosphate, 0.8 parts of diethyl maleate, and 4.5 parts of calcium dodecylbenzenesulfonate (trade name: PIONIN A-41-C, 70% methanol solution, manufactured by Takemoto Oil Fat Co., Ltd.) were dissolved, and the mixed liquid (VII) was obtained.

Separately, 107.3 parts of ion-exchange water was mixed in 206.3 parts of the aqueous solution of alkali treated gelatin, and the mixed liquid (VIII) was obtained.

The mixed liquid (VII) was added in the mixed liquid (VIII), and emulsified using the dissolver (TK ROBOMIX manufactured by Tokushu Kika Kogyo Co., Ltd.) at 40° C. After the obtained coupler compound emulsion was depressurized and heated to remove ethyl acetate, the concentration was adjusted so that the concentration of the solid content became 24.5%, and the coupler compound emulsion (b) was obtained. The particle size of the obtained coupler compound emulsion was 0:22 μm in median size, as the result of the particle size measurement (performed with LA-700, manufactured by Horiba, Ltd.).

Coupler compound E

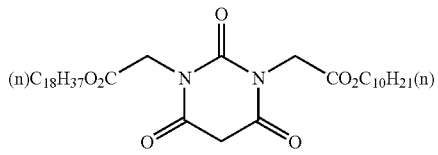

-continued

Compound G

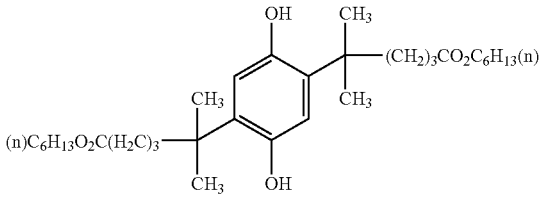

<Preparation of the Coating Liquid (b)>

The above-mentioned photolytic diazo compound microencapsulated liquid (b) and the above-mentioned coupler compound emulsion (b) were mixed so that the mass ratio of encapsulated coupler compound/diazo compound became 1.9/1. Further, the aqueous solution (5%) of polystyrene sulfonate (partly potassium hydroxide neutralized type) was mixed so as to be 0.15 parts relative to 10 parts of the capsule liquid, and the coating liquid (b) for the heat-sensitive recording layer was obtained.

(3) Preparation of the Cyan Heat-Sensitive Recording Layer Liquid

<Preparation of the Electron-Donating Dye Precursor Microencapsulated Liquid (c)>

In 18.1 parts pf ethyl acetate, 7.6 parts of the following electron-donating dye F, 6.0 parts of trimethylolpropane trimethacrylate (trade name: LIGHT ESTER TMP, manufactured by Kyoeisha Chemical Co., Ltd.), 6.0 parts of diisopropylnaphthalene (trade name: KMC 113, manufactured by Kureha Chemical Industry Co., Ltd.), and 4.0 parts of 1,1,3-tris(2-methyl-4-hydroxy-5-t-butylphenyl)butane (trade name: ADEKA ARKLS DH-37, manufactured by Asahi Denka Kogyo KK) were added, and the mixture was heated and dissolved uniformly.

In the above-mentioned mixed liquid, as capsule wall materials, 7.1 parts of the adduct of xylylene diisocyanate and trimethylolpropane (trade name: TAKENATE D110N (75% ethyl acetate solution), manufactured by Mitsui Takeda Chemical Co., Ltd.), and 5.3 parts of polymethylene polyphenyl polyisocyanate (trade name: MILIONATE MR-200, manufactured by Nippon Polyurethane Industry Co., Ltd.) were added, and further 3.1 parts of the adduct of xylylene diisocyanate and the following compound I (50% ethyl acetate solution) was added and stirred uniformly, and the mixed liquid (IX) was obtained.

Separately, in 57.6 parts of the above-mentioned aqueous solution of gelatin phthalate, 9.5 parts of ion-exchange water, 0.17 parts of alkylglucoside-based surfactant (trade name: SCRAPH AG-8 (50%); manufactured by Nippon Fine Chemical Co., Ltd.), and 4.3 parts of sodium dodecylbenzenesulfonate were added and mixed, and the mixed liquid (X) was obtained.

The mixed liquid (IX) was added in the mixed liquid (X), and emulsified and dispersed using the dissolver (TK ROBOMIX manufactured by Tokushu Kika Kogyo Co., Ltd.) at 40° C. After 21.2 parts of water and 0.12 parts of tetraethylenepentamine were added in the obtained emulsion and the mixture was uniformized, the uniform mixture was stirred at 65° C. and the encapsulation reaction was continued for 3 hours while removing ethyl acetate. And then the concentration was adjusted so that the concentration of the solid content in the capsule liquid became 33% and the microcapsule liquid was obtained. The particle size of the obtained microcapsule was 1.00 μm in median size, as the result of the particle size measurement (performed with LA-700, manufactured by Horiba, Ltd.).

Further, in 100 parts of the above-mentioned microcapsule liquid, 3.7 parts of 25% aqueous solution of sodium dodecylbenzenesulfonate (trade name: NEOPELEX F-25, manufactured by Kao Corporation), and 4.3 parts of a 4,4'-bistriazinylaminostilbene-2,2'-disulfone derivative (trade name: KAYCALL BXNL, manufactured by Nippon Soda Co., Ltd.) were added and stirred uniformly, and the microcapsule dispersion (c) was obtained.

Electron-donating dye F

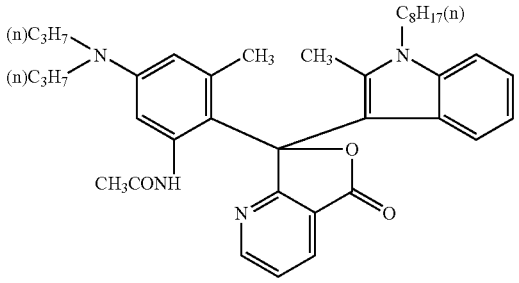

Compound I

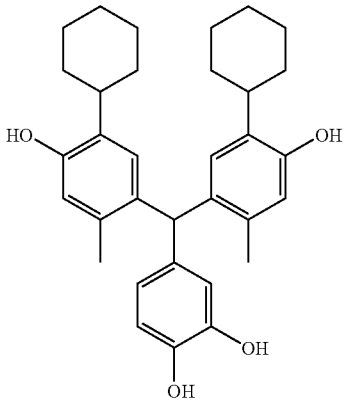

<Preparation of the Electron-Accepting Compound Dispersion (c)>

In the mixture of 8.5 parts of the above-mentioned aqueous solution of gelatin phthalate and 11.3 parts of 6% aqueous solution of PGLE (trade name: ML10, manufactured by Daicel Chemical Industries, Ltd.), 30.1 parts of ion-exchange water, 7.5 parts of 4,4'-(p-phenylenediisopropylidene)diphenol (trade name: Bisphenol P, manufactured by Mitsui Chemicals Inc.), 7.5 parts of 1,1-bis(4-hydroxyphenyl)-1-phenylethane (trade name: BISP-AP, manufactured by Honshu Chemical Industry Co., Ltd.), 3.8 parts of 2% aqueous solution of sodium 1-ethylhexyl succinate, and 1.0 part of sodium salt of 2-naphthalene sulfonate formaldehyde condensate (trade name: DEMOL NL; manufactured by Kao Corporation) were added and dispersed with a dyno mill, and the dispersion was obtained. In this dispersion, the concentration of the solid content was 26.6%.

After 31.6 parts of the above-mentioned aqueous solution of alkali treated gelatin was added in 100 parts of the above-mentioned dispersion and stirred for 30 minutes, ion-exchange water was added so that the concentration of the solid content became 23.5%, and the electron-accepting compound dispersion (c) was obtained.

<Preparation of the Coating Liquid (c)>

The above-mentioned electron-donating dye precursor microencapsulated liquid (c) and the above-mentioned electron-accepting compound dispersion (c) were mixed so that the weight ratio of the electron-accepting compound/the electron-donating dye precursor became 10/1 (mass), and the coating liquid (c) was obtained.

(4) Preparation of the Coating Liquid for the Intermediate Layer.

The aqueous solution of gelatin for making the intermediate layer was obtained as follows: 100.0 parts of alkali treated low ion gelatin (trade name: #750 Gelatin, manufactured by Nitta Gelatine Inc.), 4.8 parts of 1,2,-benzothiazoline-3-on (3.5% methanol solution, manufactured by Daito Chemical Industrial Co., Ltd.), 0.3 parts of calcium hydroxide, 6.9 parts of boric acid, and 510 parts of ion-exchange water were mixed and dissolved at 50° C.

The coating liquid for the intermediate layer was made by mixing 100 parts of the above-mentioned aqueous solution of gelatin for making the intermediate layer, 0.5 parts of sodium (4-nonylphenoxytrioxyethylene) butylsulfonate (2.0% aqueous solution, manufactured by Sankio Chemical Co., Ltd.), 0.6 parts of the aqueous solution (5%) of polystyrene sulfonate (partly potassium hydroxide neutralized type), 10 parts of the 4% aqueous solution of the following compound (J) (manufactured by Wako Pure Chemical Industries, Ltd.), 3.3 parts of the 4% aqueous solution of the following compound (J'), and 23 parts of ion-exchange water.

Compound J $$CH_2{=}CHSO_2CH_2CONHCH_2CH_2NHCOCH_2SO_2CH{=}CH_2$$

Compound J'

$$CH_2{=}CHSO_2CH_2CONHCH_2CH_2CH_2NHCOCH_2SO_2CH{=}CH_2$$

(5) Preparation of the Coating Liquid for the Light Transmissivity Adjusting Layer.

(iii-1) Preparation of the Ultraviolet Absorbent Precursor Microcapsule Liquid.

In 180 parts of ethyl acetate, as a ultraviolet absorbent, 32 parts of [2-allyl-6-(2H-benzotriazole-2-yl)-4-t-octylphenyl] benzenesulfonate, 11 parts of 2,5-di-t-octylhydroquinone, 4 parts of tricresyl phosphate, 13 parts of α-methyl styrene dimmer (trade name: MSD-100, manufactured by Mitsui Chemicals, Inc.), and 1.1 parts of calcium dodecylbenzenesulfonate (trade name: PIONIN A-41-C (70% methanol solution), manufactured by Takemoto Oil Fat Co., Ltd.) were dissolved uniformly. In the above-mentioned mixed liquid, as a capsule wall material, 65 parts of the adduct of xylylene diisocyanate and trimethylolpropane (trade name: TAKENATE D110N (75% ethyl acetate solution), manufactured by Mitsui Takeda Chemicals Inc., Ltd.) was added and stirred uniformly, and the ultraviolet absorbent precursor mixed liquid (VII) was obtained.

Separately, in the mixture of 72 parts of itaconic acid-modified polyvinyl alcohol (trade name: KL-318, manufactured by Kuraray Co., Ltd.) and 72 parts of silica-modified polyvinyl alcohol (trade name: R-1130, manufactured by Kuraray Co., Ltd.), 12.2 parts of 30% aqueous solution of phosphoric acid, and 1509 parts of ion-exchange water were mixed, and PVA aqueous solution for the ultraviolet absorbent precursor microcapsule liquid was made.

In 1509 parts of the above-mentioned PVA aqueous solution for the ultraviolet absorbent precursor microcapsule liquid, the above-mentioned ultraviolet absorbent precursor mixed liquid (VII) was added, and emulsified using the dissolver (TK ROBOMIX manufactured by Tokushu Kika Kogyo Co., Ltd.) at 20° C. After 250 parts of ion-exchange water was added in the obtained emulsion and the mixture was uniformized, the mixture was stirred at 40° C. and the encapsulation reaction was continued for 3 hours. After this, 72.5 parts of an ion-exchange resin, AMBERLITE MB-3 (manufactured by Organo Corporation) was added and stirred for further one hour. After that, the ion-exchange resin was removed by filtration and the concentration was adjusted so that the concentration of the solid content in the capsule liquid became 13%. The particle size of the obtained microcapsule was 0.23±0.05 μm in median size, as the result of the particle size measurement (performed with LA-700, manufactured by Horiba, Ltd.). In 1602 parts of this capsule liquid, 41 parts of colloidal silica (trade name: SNOWTEX OL, manufactured by Nissan Chemical Industries, Ltd.), and 4.3 parts of carboxy-modified styrene-butadiene latex (trade name: SN-307, (48% aqueous solution), manufactured by Sumitomo Nogatac Co., Ltd.) were mixed, and the ultraviolet absorbent precursor microcapsule liquid was obtained.

(iii-2) Preparation of the Coating Liquid for the Light Transmissivity Adjusting Layer.

In 1000 parts of the above-mentioned ultraviolet absorbent precursor microcapsule liquid, 296.4 parts of ion-exchange water, 19.5 parts of 4% aqueous solution of sodium hydroxide, and 51.43 parts of sodium (4-nonylphenoxytrioxyethylene) butylsulfonate (2.0% aqueous solution, manufactured by Sankyo Chemical Co., Ltd.) were mixed, and the coating liquid for the light transmissivity adjusting layer was obtained.

(6) Preparation of the Coating Liquid for the Protective Layer (iv-1) Making of the Polyvinyl Alcohol Solution for the Protective Layer The uniform polyvinyl alcohol solution for the protective layer was obtained in the following method. That is, 150 parts of a vinyl alcohol-alkylvinyl ether copolymer (trade name: EP-130, manufactured by Denki Kagaku Kogyo KK), 7.5 parts of the mixed liquid of sodium alkylsulfonate and polyoxyethylene alkyl ether phosphate (trade name: NEOSCORE CM-57, (54% aqueous solution), manufactured by Toho Chemical Industry Co., Ltd.), a silicone surfactant (trade name: SYLGARD 309, manufactured by Dow Corning Toray Silicone Co., Ltd.), and 3592 parts of ion-exchange water were mixed and dissolved while being stirred at 90° C. for one hour.

(iv-2) Making of the Pigment Dispersion Liquid for the Protective Layer

In 8 parts of barium sulfate (trade name: BF-21F, the content of barium sulfate is 93% or more, manufactured by Sakai Chemical Industry Co., Ltd.), 0.2 parts of anionic special polycarboxylic acid type polymer surfactant (trade name: POIZ 532A (40% aqueous solution), manufactured by Kao Corporation), and 11.8 parts of ion-exchange water were mixed and dispersed using a dyno mill, and the pigment dispersion liquid for the protective layer was made. The particle size of the pigment particles in the dispersion liquid was 0.15 μm or less in median size, as the result of the particle size measurement (performed with LA-910, manufactured by Horiba, Ltd.).

In 1000 parts of the above-mentioned barium sulfate dispersion liquid, 3.06 parts of aqueous dispersion of 1,2,-benzothiazoline-3-on (trade name: PROXELB. D, manufactured by C.I Co., Ltd.), 36.4 parts of wheat starch (trade name: Wheat starch S, manufactured by Shinshin Food Industry Co., Ltd.), 181 parts of colloidal silica (trade name: SNOW- TEX O (20% aqueous dispersion), manufactured by Nissan Chemical Industries, Ltd.), and 67.7 parts of acryl silicone-modified resin emulsion (trade name: ARJ-2A, 44% dispersion, manufactured by Nihon Junyaku Co., Ltd.) were mixed while stirring, and the objective dispersion was obtained.

(iv-3) Preparation of the Lubricant Emulsion for the Protective Layer

In 46.2 parts of ethyl acetate, 3.8 parts of the above-mentioned exemplary compound A-42 was added and dissolved by heating at 60° C. to give oil phase. Separately, 0.8 parts of sodium dodecylbenzenesulfonate was dissolved in 100 parts of water to give water phase. The previously prepared oil phase was added in the water phase, and emulsified using the dissolver (TK ROBOMIX manufactured by Tokushu Kika Kogyo Co., Ltd.) at 65° C. After the obtained lubricant emulsion was depressurized and heated to remove ethyl acetate, the concentration was adjusted so that the concentration of the solid content became 10%. The particle size of the obtained lubricant emulsion was 0.13 μm in median size, as the result of the particle size measurement (performed with LA-910, manufactured by Horiba, Ltd.).

(iv-4) Preparation of the Coating Blend Liquid for the Protective Layer

In 1000 parts of the above-mentioned polyvinyl alcohol solution for the protective layer, 90.4 parts of ion-exchange water, 49.4 parts of sodium (4-nonylphenoxytrioxyethylene) butylsulfonate (2.0% aqueous solution, manufactured by Sankyo Chemical Co., Ltd.), 87.6 parts of the above-mentioned the pigment dispersion liquid for the protective layer, 101.2 parts of the above-mentioned lubricant emulsion for the protective layer, 153.9 parts of 4% aqueous solution of the above-mentioned compound (J) (manufactured by Wako Pure Chemical Industries, Ltd.), and 51.3 parts of 4% aqueous solution of the above-mentioned compound (J') (manufactured by Wako Pure Chemical Industries, Ltd.) were uniformly mixed, and the coating blend liquid for the protective layer was obtained.

(7) The Support with a Undercoat Layer

<Manufacture of the Undercoat Layer Liquid>

In 12.85 parts of acetoacetyl-modified PVA (polymerization degree: about 1000, trade name: Gosefimer Z-210, manufactured by Nippon Synthetic Chemical Industry Co., Ltd.), and 87.15 parts of water were added, and stirred and dissolved at 90° C. or higher.

While 100 parts of this acetoacetylimodified PVA solution was stirred, 2.58 part of water was added, and then 18.90 parts of swelling synthetic mica dispersion liquid MEB-3 (Aspect ratio: about 1000, mica dispersion liquid of 2.0 μm in average particle size), which is manufactured by Co-op Chemical Co., Ltd., was added and stirred sufficiently. After that, 84.90 parts of methanol was gradually added while stirring, further 3.10 parts of 1.66% methanol solution of a polyethylene oxide surfactant was added, and finally 0.45 parts of 1N (1 mol/$dm^3$) sodium hydroxide was added, and the undercoat layer liquid of 6.87% was obtained.

(8) Manufacture of the Support with a Undercoat Layer

Wood pulp of 100 parts of one or more kinds of LBKP (broadleaf tree breached kraft pulp) was beaten with a disk refiner to a Canadian freeness of 300 cc, and 0.5 parts of epoxidized behenic acid amide, 1.0 part of anionic polyacrylamide, 1.0 part of aluminum sulfate, 0.1 parts of polyamide polyamine epichlorohydrin, and 0.5 parts of cationic polyacrylamide were each added in absolute dry weight relative to pulp, and paper was made by a Fourdrinier paper machine. Further, the both sides of the base paper were applied with polyvinyl alcohol solution containing calcium chloride and a water-soluble fluorescent whitening agent by the use of a size press machine to make base paper of 114/$m^2$ in basis weight, and the thickness was adjusted to be 100 μm by calendaring treatment.

Next, after corona discharge treatment was carried out on the both sides of the base paper, polyethylene was coated using a melt extruding machine so as to be 36 μm in thickness, and thus a resin layer having a mat surface was formed (this surface is called the reverse side). Subsequently, on the opposite side on which the above-mentioned resin layer had been formed, polyethylene containing 10% by mass of anatase-type titanium dioxide and a minute amount of ultramarine was coated using a melt extruding machine so as to be 50 μm in thickness, and thus a resin layer having a glossy surface was formed (this surface is called the front side). After corona discharge treatment was carried out on the polyethylene resin coated surface of the reversed side, as antistatic agents, the aqueous dispersion obtained by dispersing aluminum oxide (trade name: Alumina Sol 100, manufactured by Nissan Chemical Industries, Ltd.)/silicon dioxide (trade name: SNOWTEX O, manufactured by Nissan Chemical Industries, Ltd.) in a weight ratio of 1/2 in water was applied so as to become 0.2 g/$m^2$ in weight after being dried. Subsequently, after corona discharge treatment was carried out on the polyethylene resin coated surface of the front side, the obtained coating liquid for the undercoat layer was kept warm at 40° C., and applied with an oblique line mesh type gravure roll at 100 mesh and dried. At that time, the amount applied was 12.5 g/$m^2$ before drying.

(9) Application of each of the Coating Liquids for the Heat-Sensitive Recording Layer On the above-mentioned support with the undercoat layer, seven layers of the coating liquid for the heat-sensitive recording layer (c), the coating liquid for the intermediate layer, the coating liquid for the heat-sensitive recording layer (b), the coating liquid for the intermediate layer, the coating liquid for the heat-sensitive recording layer (a), the coating liquid for the light transmissivity adjusting layer, and the coating liquid for the protective layer were applied at the same time in this order from beneath by the slide bead method, and dried under the conditions of 30° C. in temperature and 30% in humidity and then 40° C. in temperature and 30% in humidity, and a multicolored heat-sensitive recording material was obtained.

At this time, the application was carried out so that as for the application amount of the above-mentioned coating liquid for the heat-sensitive recording layer (a), the application amount of diazo compound (A) contained in the liquid became 0.078 g/$m^2$ as the application amount of the solid content, similarly as for the application amount of the above-mentioned coating liquid for the heat-sensitive recording layer (b), the application amount of diazo compound (D) contained in the liquid became 0.206 g/m2 as the application amount of the solid content, and similarly as for the application amount of the above-mentioned coating liquid for the heat-sensitive recording layer (c), the application amount of electron-donating dye (H) contained in the liquid became 0.355 g/$m^2$ as the application amount of the solid content. Moreover, the application was also carried out so that as for the above-mentioned coating liquid for the intermediate layer, the application amount of the solid content of the layer between (a) and (b) became 2.40 g/$m^2$, and the application amount of the solid content of the layer between (b) and (c) became 3.43 g/$m^2$, as for the above-mentioned coating liquid for the light transmissivity adjusting layer, the application amount of the solid content became 2.35 g/m2, and as for the protective layer, the application amount of the solid content became 1.39 g/m$^2$.

Example 8

The heat-sensitive recording material was manufactured in the same way as in Example 7, except that the exemplary compound A-42 used in "(6) Preparation of the lubricant emulsion for the protective layer" in Example 7 was replaced with the exemplary compound A-43 of the same amount of the solid content.

Example 9

The heat-sensitive recording materiel was manufactured in the same way as in Example 7, except that the exemplary compound A-42 used in "(6) Preparation of the lubricant emulsion for the protective layer" in Example 7 was replaced with the exemplary compound A-44 of the same amount of the solid content.

Example 10

The heat-sensitive recording material was manufactured in the same way as in Example 7, except that the exemplary compound A-42 used in "(6) Preparation of the lubricant emulsion for the protective layer" in Example 7 was replaced with the exemplary compound A-45 of the same amount of the solid content.

Example 11

The heat-sensitive recording material was manufactured in the same way as in Example 7, except that the exemplary compound A-42 used in "(6) Preparation of the lubricant emulsion for the protective layer" in Example 7 was replaced with the exemplary compound A-46 of the same amount of the solid content.

Comparative Example 2

The heat-sensitive recording material was manufactured in the same way as in Example 7, except for using "zinc stearate" (trade name: L111, available from Chukyo Yushi Co., Ltd.) of the same amount of the solid content in place of "(6) The lubricant emulsion for the protective layer".

[Recording, and Evaluation of Thermal Head Staining, Coefficient of Dynamic Friction, and Disagreement in Registration]

<Recording>

Recording of the heat sensitive recording material obtained in Examples 7 to 11 and Comparative Example 2 was carried out using the thermal head KST (manufactured by Kyocera Corporation), at recording energy of 0 to 90 mL/mm$^2$ and printing speed of 2 mm/s, and the following evaluation was carried out.

1. Evaluation of Thermal Head Staining

The head staining was evaluated by the number of sheets that were printed until "a printing streak" was generated when printing by a printer was continuously carried out for up to 2000 sheets.

Here, "a printing streak" refers to a streak-like irregularity which has low color density and is caused in the printing sample. Generally, when recording is continued, staining occurs due to lubricant and worn away paper accumulating on the thermal head. When a large amount accumulates, the contact between the thermal head and paper is lowered, which causes a reduction in the heat transference to paper, resulting in the generation of a printing streak. The higher the numerical value of the number of sheets when a printing streak is generated is, the harder the generation of a printing streak is, which shows the printing is favorable. The results are shown in Table 2.

2. Measurement and Evaluation of Coefficient of Dynamic Friction

Figure 2:
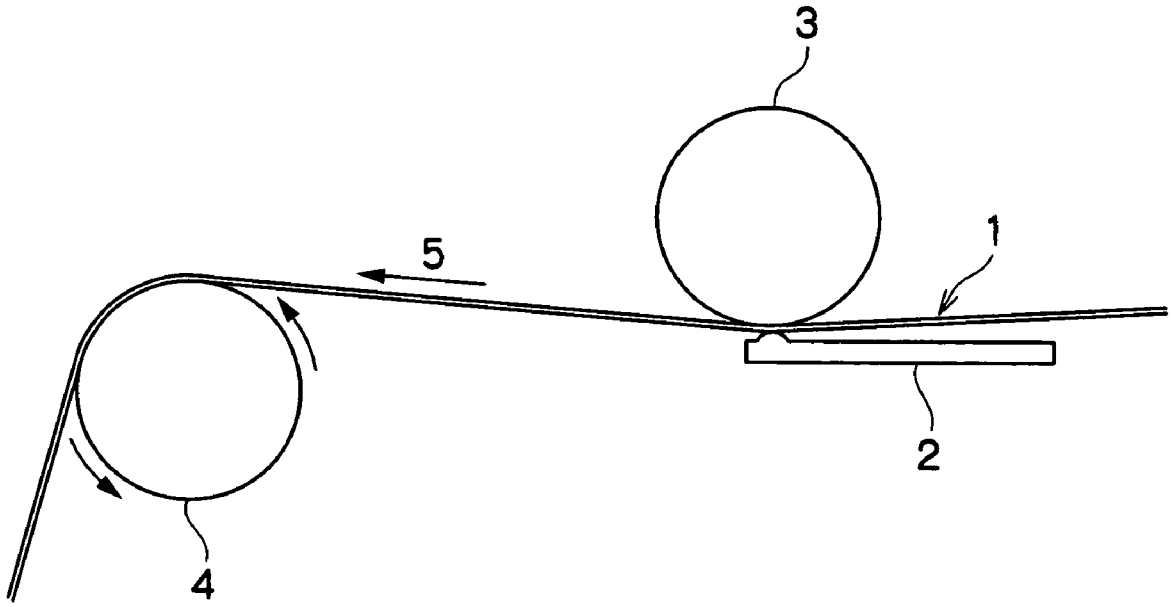
FIG. 2 illustrates the measuring method of the coefficient of dynamic friction in the Examples and Comparative Examples.

The measurement method of the coefficient of dynamic friction will be described using FIG. 2. In FIG. 2, 1 denotes a heat-sensitive recording material, 2 denotes a thermal head, 3 denotes a platen roll, 4 denotes a capstan roller, and 5 denotes the recording direction. The torque value of the capstan roller 4 in FIG. 2 was measured and the coefficient of dynamic friction was calculated as follows:

1) The torque value $T_1$ when the heat-sensitive recording material is transported without thermal recording is measured.

2) Next, the thermal recording of the heat-sensitive recording material is carried out, and the torque value $T_2$ at that time is measured.

3) From the above 1) and 2), the increment of torque values for the thermal recording, $\Delta T = T_2 - T_1$ is calculated.

4) The coefficient of dynamic friction $\mu$ is calculated by using $\mu = \Delta T/N$.

N is a 7 kg weight at head loading. The coefficient of dynamic friction shows fluctuation by recording energy and the fluctuation range $\Delta\mu$ (difference between the maximum value and minimum value) is shown in Table 2. The smaller the numerical value is, the better the printing.

3. Measurement and Evaluation of Disagreement in Registration

A gray line 0.3 mm in width is thermally recorded in a direction orthogonal to the direction of conveyance of the heat-sensitive recording material, and the density profile of each of Y, M and C of the printed sample of the heat-sensitive recording material is measured with a micro density meter.

Figure 3:
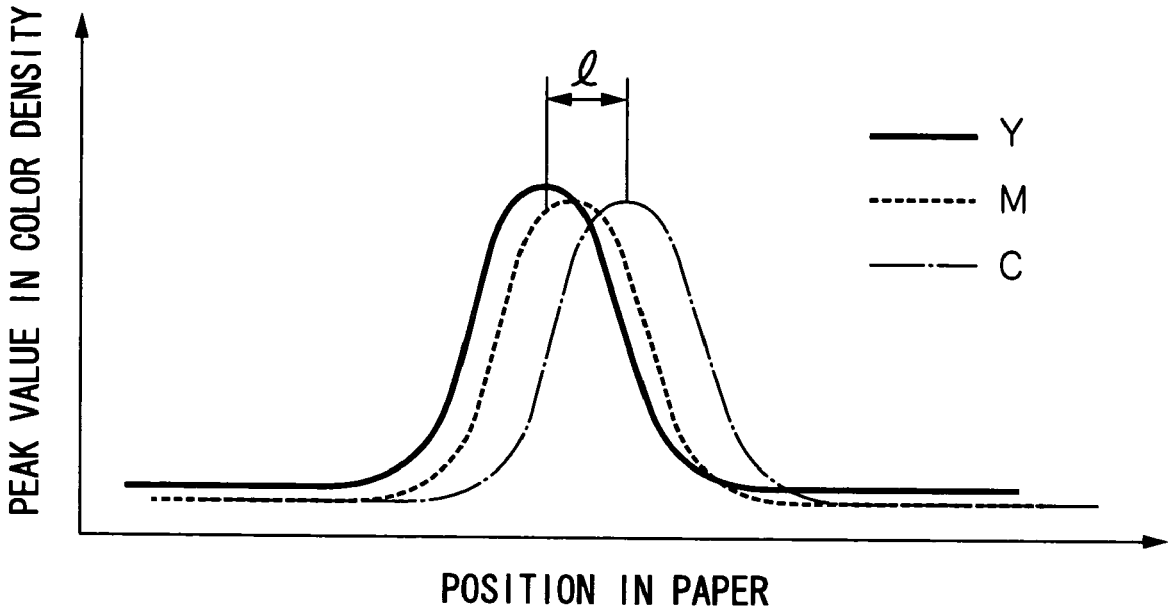
FIG. 3 illustrates the disagreement in registration found from the coloring density peak of each of Y, M and C in the Examples and Comparative Examples.

The gap width of the maximum density peak values of color density between Y-M, M-C, and C-Y is calculated, respectively, and the maximum value in those gap widths was assumed to be "disagreement in registration (1)" as shown in FIG. 3. The results are shown in Table 2. The smaller the numerical value of disagreement in registration (1) is, the better the heat-sensitive recording material.

TABLE 2

| | Fluctuation range in coefficient of dynamic friction ($\Delta\mu$) | The number of sheets until a printing streak is generated (sheets) | The maximum disagreement in registration ($\mu$m) |
|---|---|---|---|
| Example 7 | 0.11 | 1800 | 60 |
| Example 8 | 0.12 | 1600 | 65 |
| Example 9 | 0.12 | 2000 | 65 |
| Example 10 | 0.13 | 1600 | 65 |
| Example 11 | 0.13 | 1200 | 65 |
| Comparative Example 2 | 0.13 | 600 | 65 |

As shown in Table 2, it is found that a printing streak has been generated at the initial stage of the print in Comparative Example 2. On the other hand, it is found that a printing streak is extremely hard to generate, the maximum disagreement in registration is small, and consequently the heat-sensitive recording material of the invention is good, in all of the Examples.

According to the present invention, it is possible to provide heat-sensitive recording materials in which head staining is suppressed and transportability is improved, method for manufacturing the heat-sensitive recording materials, and a heat-sensitive recording method using the heat-sensitive recording materials.

Hereinafter, exemplary embodiments of the invention will be described. However, the invention is not limited to these embodiment.

[1] A heat-sensitive recording material comprising a support, and at least one heat-sensitive recording layer and a protective layer provided on the support in this order, wherein the protective layer contains a compound represented by the following Formula (1) and/or a compound represented by the following Formula (2):

Formula (1)

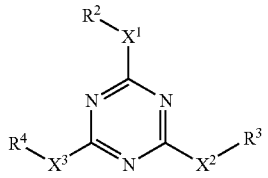

Formula (2)

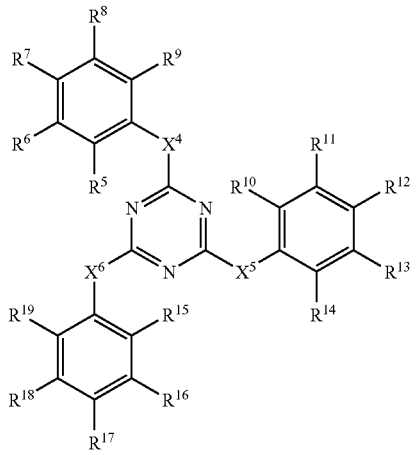

wherein in Formulae (1) and (2), $X^1$ to $X^6$ each independently represent $NR^1$, S or O; $R^1$ represents a hydrogen atom, an alkyl group, an aryl group, an acyl group, an alkoxycarbonyl group, an aryloxycarbonyl group, or a carbamoyl group; $R^2$, $R^3$ and $R^4$ each independently represent a hydrogen atom, an alkyl group or a heterocyclic group; when at least two of $R^1$, $R^2$, $R^3$ and $R^4$ are other than a hydrogen atom, they may be bonded to each other to form a ring; $R^5$ to $R^{19}$ each independently represent a hydrogen atom, an alkyl group, an aryl group, an alkoxy group, an aryloxy group, an alkylthio group, an arylthio group, an acyloxy group, an acylamino group, an alkoxycarbonyl group, an aryloxycarbonyl group, a carbamoyl group, a sulfamoyl group, or a halogen atom; and when at least two of $R^5$ to $R^{19}$ are other than a hydrogen atom, they may be bonded to each other to form a ring.

[2] The heat-sensitive recording material of embodiment [1], wherein at least one of $X^1$ to $X^3$is S, O or NH, and/or at least one of $X^4$to $X^6$ is S, O or NH.

[3] The heat-sensitive recording material of embodiment [1], wherein $R^2$, $R^3$ and $R^4$ are each independently an alkyl group having 8 or more carbon atoms.

[4] The heat-sensitive recording material of embodiment [1], wherein $R^5$ to $R^{19}$ are each independently a group having 4 or more carbon atoms.

[5] The heat-sensitive recording material of embodiment [1], wherein the protective layer is a top surface layer of the heat sensitive recording material.

[6] The heat-sensitive recording material of embodiment [1], wherein the at least one heat-sensitive recording layer is a heat-sensitive recording layer containing an electron-donating dye precursor and an electron-accepting compound, or a heat-sensitive recording layer containing a photolytic diazo compound and a coupler.

[7] The heat-sensitive recording material of embodiment [6], wherein the electron-donating dye precursor and/or the photolytic diazo compound are contained in microcapsules or composite fine particles.

[8] The heat-sensitive recording material of embodiment [1], wherein the at least one heat-sensitive recording layer includes two or more layers, each forming a color in a different hue.

[9] A heat-sensitive recording method comprising recording on the heat-sensitive recording material of embodiment [1] using a thermal head with a carbon ratio of 75% or more.

[10] The heat-sensitive recording method of embodiment [9], wherein at least one of $X^1$ to $X^3$ is S, O or NH, and/or at least one of $X^4$ to $X^6$ is S, O or NH.

[11] The heat-sensitive recording method of embodiment [9], wherein $R^2$, $R^3$, and $R^4$ are each independently an alkyl group having 8 or more carbon atoms.

[12] The heat-sensitive recording method of embodiment [9], wherein $R^5$ to $R^{19}$ are each independently a group having 4 or more carbon atoms.

[13] The heat-sensitive recording method of embodiment [9], wherein the protective layer is a top surface layer of the heat-sensitive recording material.

[14] A method for manufacturing a heat-sensitive recording material, comprising:

dispersing a compound represented by the following Formula (1) and/or a compound represented by the following Formula (2) in an aqueous solution of a high-molecular weight compound through solid dispersion or emulsification, to form a dispersion liquid;

and applying a coating liquid containing the dispersion liquid onto a support:

Formula (1)

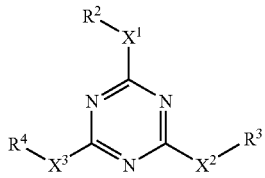

Formula (2)

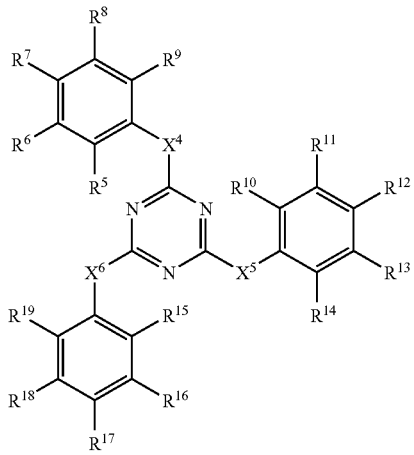

wherein in Formulae (1) and (2), $X^1$ to $X^6$ each independently represent $NR^1$, S or O; $R^1$ represents a hydrogen atom, an alkyl group, an aryl group, an acyl group, an alkoxycarbonyl group, an aryloxycarbonyl group, or a carbamoyl group; $R^2$, $R^3$ and $R^4$ each independently represent a hydrogen atom, an alkyl group or a heterocyclic group; when at least two of $R^1$, $R^2$, $R^3$ and $R^4$ are other than a hydrogen atom, they may be bonded to each other to form a ring; $R^5$ to $R^{19}$ each independently represent a hydrogen atom, an alkyl group, an aryl group, an alkoxy group, an aryloxy group, an alkylthio group, an arylthio group, an acyloxy group, an acylamino group, an alkoxycarbonyl group, an aryloxycarbonyl group, a carbamoyl group, a sulfamoyl group, or a halogen atom; and when at least two of $R^5$ to $R^{19}$ are other than a hydrogen atom, they may be bonded to each other to form a ring.

[15] The method for manufacturing a heat-sensitive recording material of embodiment [14], wherein at least one of $X^1$ to $X^3$ is S, O or NH, and at least one of $X^4$ to $X^6$ is S, O or NH.

[16] The method for manufacturing a heat-sensitive recording material of embodiment [14], wherein $R^2$, $R^3$, and $R^4$ are each independently an alkyl group having 8 or more carbon atoms.

[17] The method for manufacturing a heat-sensitive recording material of embodiment [14], wherein $R^5$ to $R^{19}$ are each independently a group having 4 or more carbon atoms.

What is claimed is:

1. A heat-sensitive recording material, comprising a support, and at least one heat-sensitive recording layer and a protective layer provided on the support in this order, wherein the protective layer contains a compound represented by the following Formula (1) and/or a compound represented by the following Formula (2):

Formula (1)

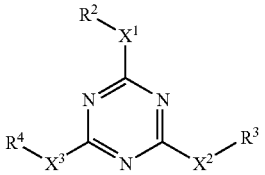

Formula (2)

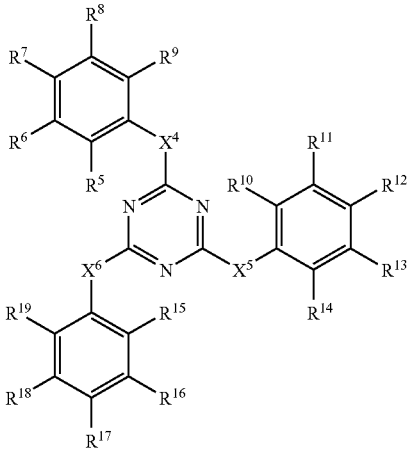

wherein in Formulae (1) and (2), $X^1$ to $X^6$ each independently represent $NR^1$, S or O; $R^1$ represents a hydrogen atom, an alkyl group, an aryl group, an acyl group, an alkoxycarbonyl group, an aryloxycarbonyl group, or a carbamoyl group; $R^2$, $R^3$ and $R^4$ each independently represent a hydrogen atom, an alkyl group or a heterocyclic group; when at least two of $R^1$, $R^2$, $R^3$ and $R^4$ are other than a hydrogen atom, they may be bonded to each other to form a ring; $R^5$ to $R^{19}$ each independently represent a hydrogen atom, an alkyl group, an aryl group, an alkoxy group, an aryloxy group, an alkylthio group, an arylthio group, an acyloxy group, an acylamino group, an alkoxycarbonyl group, an aryloxycarbonyl group, a carbamoyl group, a sulfamoyl group, or a halogen atom; and when at least two of $R^5$ to $R^{19}$ are other than a hydrogen atom, they may be bonded to each other to form a ring.

2. The heat-sensitive recording material of claim 1, wherein at least one of $X^1$ to $X^3$ is S, O or NH; and/or at least one of $X^4$ to $X^6$ is S, O or NH.

3. The heat-sensitive recording material of claim 1, wherein $R^2$, $R^3$ and $R^4$ are each independently an alkyl group having 8 or more carbon atoms.

4. The heat-sensitive recording material of claim 1, wherein $R^5$ to $R^{19}$ are each independently a group having 4 or more carbon atoms.

5. The heat-sensitive recording material of claim 1, wherein the protective layer is a top surface layer of the heat sensitive recording material.

6. The heat-sensitive recording material of claim 1, wherein the at least one heat-sensitive recording layer is a heat-sensitive recording layer containing an electron-donating dye precursor and an electron-accepting compound, or a heat-sensitive recording layer containing a photolytic diazo compound and a coupler.

7. The heat-sensitive recording material of claim 6, wherein the electron-donating dye precursor and/or the photolytic diazo compound are contained in microcapsules or composite fine particles.

8. The heat-sensitive recording material of claim 1, wherein the at least one heat-sensitive recording layer includes two or more layers, each forming a color in a different hue.

9. A heat-sensitive recording method comprising recording on the heat-sensitive recording material of claim 1 using a thermal head with a carbon ratio of 75% or more.

10. The heat-sensitive recording method of claim 9, wherein at least one of $X^1$ to $X^3$ is S, O or NH; and/or at least one of $X^4$ to $X^6$ is S, O or NH.

11. The heat-sensitive recording method of claim 9, wherein $R^2$, $R^3$, and $R^4$ are each independently an alkyl group having 8 or more carbon atoms.

12. The heat-sensitive recording method of claim 9, wherein $R^5$ to $R^{19}$ are each independently a group having 4 or more carbon atoms.

13. The heat-sensitive recording method of claim 9, wherein the protective layer is a top surface layer of the heat-sensitive recording material.

14. A method for manufacturing a heat-sensitive recording material, comprising:

applying a heat-sensitive recording layer;

dispersing a compound represented-by the following Formula (1) and/or a compound represented by the following Formula (2) in an aqueous solution of a high-molecular weight compound through solid dispersion or emulsification, to form a dispersion liquid;

and applying a coating liquid containing the dispersion liquid onto the heat-sensitive recording layer:

Formula (1)

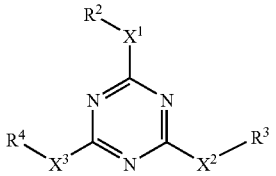

-continued

Formula (2)

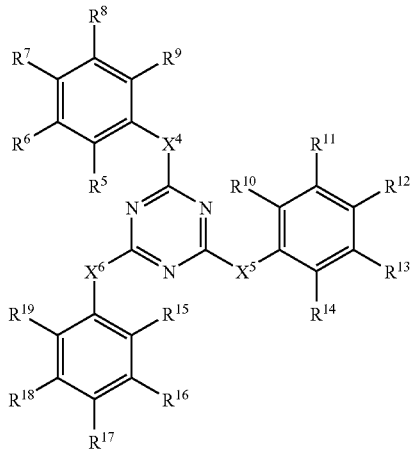

wherein in Formulae (1) and (2), $X^1$ to $X^6$ each independently represent $NR^1$, S or O; $R^1$ represents a hydrogen atom, an alkyl group, an aryl group, an acyl group, an alkoxycarbonyl group, an aryloxycarbonyl group, or a carbamoyl group; $R^2$, $R^3$ and $R^4$ each independently represent a hydrogen atom, an alkyl group or a heterocyclic group; when at least two of $R^1$, $R^2$, $R^3$ and $R^4$ are other than a hydrogen atom, they may be bonded to each other to form a ring; $R^5$ to $R^{19}$ each independently represent a hydrogen atom, an alkyl group, an aryl group, an alkoxy group, an aryloxy group, an alkylthio group, an arylthio group, an acyloxy group, an acylamino group, an alkoxycarbonyl group, an aryloxycarbonyl group, a carbanoyl group, a sulfamoyl group, or a halogen atom; and when at least two of $R^5$ to $R^{19}$ are other than a hydrogen atom, they may be bonded to each other to form a ring.

15. The method for manufacturing a heat-sensitive recording material of claim 14, wherein at least one of $X^1$ to $X^3$ is S, O or NH; and/or at least one of $X^4$ to $X^6$ is S, O or NH.

16. The method for manufacturing a heat-sensitive recording material of claim 14, wherein $R^2$, $R^3$, and $R^4$ are each independently an alkyl group having 8 or more carbon atoms.

17. The method for manufacturing a heat-sensitive recording material of claim 14, wherein $R^5$ to $R^{19}$ are each independently a group having 4 or more carbon atoms.

* * * * *